US010791769B2

(12) United States Patent
Bless et al.

(10) Patent No.: US 10,791,769 B2
(45) **Date of Patent: *Oct. 6, 2020**

(54) AEROSOL DELIVERY DEVICE PROVIDING FLAVOR CONTROL

(71) Applicant: RAI STRATEGIC HOLDINGS, INC., Winston-Salem, NC (US)

(72) Inventors: Alfred C. Bless, Asheboro, NC (US); Jason M. Short, Winston-Salem, NC (US); Stephen B. Sears, Siler City, NC (US)

(73) Assignee: RAI STRATEGIC HOLDINGS, INC., Winston-Salem, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/718,710

(22) Filed: Dec. 18, 2019

(65) Prior Publication Data

US 2020/0120977 A1 Apr. 23, 2020

Related U.S. Application Data

(63) Continuation of application No. 15/858,193, filed on Dec. 29, 2017, now Pat. No. 10,555,558.

(51) Int. Cl.
*A24F 13/00* (2006.01)
*A24F 47/00* (2020.01)
(Continued)

(52) U.S. Cl.
CPC ..... *A24F 47/008* (2013.01); *A24F 40/10* (2020.01); *A24F 40/30* (2020.01); *H05B 3/44* (2013.01)

(58) Field of Classification Search
CPC ..... A24F 47/00
(Continued)

(56) References Cited

U.S. PATENT DOCUMENTS 1,514,682 A 11/1924 Wilson
1,771,366 A 7/1930 Wyss et al.
(Continued)

FOREIGN PATENT DOCUMENTS

AU 276250 7/1965
CA 2 641 869 5/2010
(Continued)

OTHER PUBLICATIONS

International Search Report dated Apr. 12, 2019 in corresponding International Application No. PCT/IB2018/060377 filed Dec. 19, 2018.

*Primary Examiner* — Phuong K Dinh
(74) *Attorney, Agent, or Firm* — Womble Bond Dickinson (US) LLP

(57) ABSTRACT

The present disclosure relates to a cartridge for an aerosol delivery device and an aerosol delivery device that includes a cartridge. In various implementations the cartridge comprises a reservoir tank configured to contain an aerosol precursor composition, an opening configured to the permit aerosol precursor composition to pass therethrough, and two or more separate sections. At least two of the sections are configured to permit the aerosol precursor composition to pass therethrough, and at least one of the sections comprises a flavor section that contains a flavorant. A selected section of the two or more sections is configured to align with the opening so as to allow the aerosol precursor composition to flow from the reservoir tank through the opening and the selected section such that, when the flavor section is selected, a flavor from the flavorant is imparted to the aerosol precursor composition.

28 Claims, 14 Drawing Sheets

(51) Int. Cl.
*A24F 40/30* (2020.01)
*A24F 40/10* (2020.01)
*H05B 3/44* (2006.01)

(58) Field of Classification Search
USPC ..... 131/328–329
See application file for complete search history.

(56) References Cited

U.S. PATENT DOCUMENTS 2,033,909 A 3/1936 Cox
2,057,353 A 10/1936 Whittemore, Jr.
2,104,266 A 1/1938 McCormick
3,200,819 A 8/1965 Gilbert
3,479,561 A 11/1969 Janning
3,901,248 A 8/1975 Lichtneckert et al.
4,284,089 A 8/1981 Ray
4,303,083 A 12/1981 Burruss, Jr.
4,735,217 A 4/1988 Gerth et al.
4,793,365 A 12/1988 Sensabaugh, Jr. et al.
4,848,374 A 7/1989 Chard et al.
4,893,639 A 1/1990 White
4,907,606 A 3/1990 Lilja et al.
4,922,901 A 5/1990 Brooks et al.
4,945,931 A 8/1990 Gori
4,947,874 A 8/1990 Brooks et al.
4,947,875 A 8/1990 Brooks et al.
4,986,286 A 1/1991 Roberts et al.
4,989,619 A 2/1991 Clearman et al.
5,019,122 A 5/1991 Clearman et al.
5,042,510 A 8/1991 Curtiss et al.
5,060,671 A 10/1991 Counts et al.
5,093,894 A 3/1992 Deevi et al.
5,099,861 A 3/1992 Clearman et al.
5,101,839 A 4/1992 Jakob et al.
5,105,831 A 4/1992 Banerjee et al.
5,105,836 A 4/1992 Gentry et al.
5,144,962 A 9/1992 Counts et al.
5,154,192 A 10/1992 Sprinkel et al.
5,159,942 A 11/1992 Brinkley et al.
5,203,355 A 4/1993 Clearman et al.
5,224,498 A 7/1993 Deevi et al.
5,228,460 A 7/1993 Sprinkel et al.
5,249,586 A 10/1993 Morgan et al.
5,261,424 A 11/1993 Sprinkel, Jr.
5,271,419 A 12/1993 Arzonico et al.
5,322,075 A 6/1994 Deevi et al.
5,327,917 A 7/1994 Lekwauwa et al.
5,353,813 A 10/1994 Deevi et al.
5,369,723 A 11/1994 Counts et al.
5,372,148 A 12/1994 McCafferty et al.
5,388,574 A 2/1995 Ingebrethsen et al.
5,396,911 A 3/1995 Casey, III et al.
5,408,574 A 4/1995 Deevi et al.
5,468,936 A 11/1995 Deevi et al.
5,469,871 A 11/1995 Barnes et al.
5,498,850 A 3/1996 Das
5,498,855 A 3/1996 Deevi et al.
5,515,842 A 5/1996 Ramseyer et al.
5,530,225 A 6/1996 Hajaligol
5,533,530 A 7/1996 Young et al.
5,564,442 A 10/1996 MacDonald et al.
5,573,692 A 11/1996 Das et al.
5,588,446 A 12/1996 Clearman
5,591,368 A 1/1997 Fleischhauer et al.
5,649,554 A 7/1997 Sprinkel et al.
5,659,656 A 8/1997 Das
5,665,262 A 9/1997 Hajaligol et al.
5,666,977 A 9/1997 Higgins et al.
5,687,746 A 11/1997 Rose et al.
5,715,844 A 2/1998 Young et al.
5,726,421 A 3/1998 Fleischhauer et al.
5,727,571 A 3/1998 Meiring et al.
5,743,251 A 4/1998 Howell et al.
5,799,663 A 9/1998 Gross et al.
5,819,756 A 10/1998 Mielordt
5,865,185 A 2/1999 Collins et al.
5,865,186 A 2/1999 Volsey, II
5,878,752 A 3/1999 Adams et al.
5,894,841 A 4/1999 Voges
5,934,289 A 8/1999 Watkins et al.
5,954,979 A 9/1999 Counts et al.
5,967,148 A 10/1999 Harris et al.
5,998,868 A 12/1999 Pogge et al.
6,040,560 A 3/2000 Fleischhauer et al.
6,053,176 A 4/2000 Adams et al.
6,089,857 A 7/2000 Matsuura et al.
6,095,153 A 8/2000 Kessler et al.
6,125,853 A 10/2000 Susa et al.
6,155,268 A 12/2000 Takeuchi
6,164,287 A 12/2000 White
6,196,218 B1 3/2001 Voges
6,196,219 B1 3/2001 Hess et al.
6,598,607 B2 7/2003 Adiga et al.
6,601,776 B1 8/2003 Oljaca et al.
6,615,840 B1 9/2003 Fournier et al.
6,688,313 B2 2/2004 Wrenn et al.
6,772,756 B2 8/2004 Shayan
6,803,545 B2 10/2004 Blake et al.
6,854,461 B2 2/2005 Nichols
6,854,470 B1 2/2005 Pu
7,040,314 B2 5/2006 Nguyen et al.
7,117,867 B2 10/2006 Cox et al.
7,293,565 B2 11/2007 Griffin et al.
7,513,253 B2 4/2009 Kobayashi et al.
7,726,320 B2 6/2010 Robinson et al.
7,775,459 B2 8/2010 Martens, III et al.
7,832,410 B2 11/2010 Hon
7,845,359 B2 12/2010 Montaser
7,896,006 B2 3/2011 Hamano et al.
8,127,772 B2 3/2012 Montaser
8,205,622 B2 6/2012 Pan
8,314,591 B2 11/2012 Terry et al.
8,365,742 B2 2/2013 Hon
8,402,976 B2 3/2013 Fernando et al.
8,424,538 B2 4/2013 Thomas et al.
8,430,106 B2 4/2013 Potter et al.
8,459,272 B2 6/2013 Karles et al.
8,464,726 B2 6/2013 Sebastian et al.
8,469,035 B2 6/2013 Banerjee et al.
8,499,766 B1 8/2013 Newton
8,528,569 B1 9/2013 Newton
8,539,959 B1 9/2013 Scatterday
8,550,069 B2 10/2013 Alelov
8,589,804 B2 11/2013 Seth et al.
8,617,263 B2 12/2013 Banerjee et al.
8,671,951 B2 3/2014 Ercelebi et al.
8,678,013 B2 3/2014 Crooks et al.
8,839,799 B2 9/2014 Conner et al.
8,851,081 B2 10/2014 Fernando et al.
9,004,073 B2 4/2015 Tucker et al.
9,484,155 B2 11/2016 Peckerar et al.
9,839,799 B2 12/2017 Siegemund
10,285,451 B2 5/2019 Bless et al.
2002/0146242 A1 10/2002 Vieira
2003/0226837 A1 12/2003 Blake et al.
2004/0118401 A1 6/2004 Smith et al.
2004/0129280 A1 7/2004 Woodson et al.
2004/0173229 A1 9/2004 Crooks et al.
2004/0191322 A1 9/2004 Hansson
2004/0200488 A1 10/2004 Felter et al.
2004/0226568 A1 11/2004 Takeuchi et al.
2005/0016550 A1 1/2005 Katase
2005/0066986 A1 3/2005 Nestor et al.
2006/0016453 A1 1/2006 Kim
2006/0191546 A1 8/2006 Takano et al.
2006/0196518 A1 9/2006 Hon
2007/0000505 A1 1/2007 Zhuang et al.
2007/0023056 A1 2/2007 Cantrell et al.
2007/0074734 A1 4/2007 Braunshteyn et al.
2007/0102013 A1 5/2007 Adams et al.
2007/0215167 A1 9/2007 Crooks et al.
2007/0215168 A1 9/2007 Banerjee et al.
2008/0085103 A1 4/2008 Beland et al.
2008/0092912 A1 4/2008 Robinson et al.

(56) References Cited

U.S. PATENT DOCUMENTS

| | | | |
|---|---|---|---|
| 2008/0257367 | A1 | 10/2008 | Paterno et al. |
| 2008/0276947 | A1 | 11/2008 | Martzel |
| 2008/0302374 | A1 | 12/2008 | Wengert et al. |
| 2009/0044817 | A1 | 2/2009 | Besso et al. |
| 2009/0095311 | A1 | 4/2009 | Hon |
| 2009/0095312 | A1 | 4/2009 | Heibrich et al. |
| 2009/0126745 | A1 | 5/2009 | Hon |
| 2009/0139533 | A1 | 6/2009 | Park et al. |
| 2009/0188490 | A1 | 7/2009 | Hon |
| 2009/0230117 | A1 | 9/2009 | Fernando et al. |
| 2009/0272379 | A1 | 11/2009 | Thorens et al. |
| 2009/0283103 | A1 | 11/2009 | Nielsen et al. |
| 2009/0320863 | A1 | 12/2009 | Fernando et al. |
| 2010/0043809 | A1 | 2/2010 | Magnon |
| 2010/0083959 | A1 | 4/2010 | Siller |
| 2010/0200006 | A1 | 8/2010 | Robinson et al. |
| 2010/0229881 | A1 | 9/2010 | Hearn |
| 2010/0242974 | A1 | 9/2010 | Pan |
| 2010/0307518 | A1 | 12/2010 | Wang |
| 2010/0313901 | A1 | 12/2010 | Fernando et al. |
| 2011/0005535 | A1 | 1/2011 | Xiu |
| 2011/0011396 | A1 | 1/2011 | Fang |
| 2011/0036363 | A1 | 2/2011 | Urtsev et al. |
| 2011/0036365 | A1 | 2/2011 | Chong et al. |
| 2011/0094523 | A1 | 4/2011 | Thorens et al. |
| 2011/0126848 | A1 | 6/2011 | Zuber et al. |
| 2011/0155153 | A1 | 6/2011 | Thorens et al. |
| 2011/0155718 | A1 | 6/2011 | Greim et al. |
| 2011/0168194 | A1 | 7/2011 | Hon |
| 2011/0265806 | A1 | 11/2011 | Alarcon et al. |
| 2011/0268809 | A1 | 11/2011 | Brinkley et al. |
| 2011/0271968 | A1 | 11/2011 | Carpenter et al. |
| 2011/0309157 | A1 | 12/2011 | Yang et al. |
| 2012/0042885 | A1 | 2/2012 | Stone et al. |
| 2012/0060853 | A1 | 3/2012 | Robinson et al. |
| 2012/0067360 | A1 | 3/2012 | Conner et al. |
| 2012/0111347 | A1 | 5/2012 | Hon |
| 2012/0132643 | A1 | 5/2012 | Choi et al. |
| 2012/0227752 | A1 | 9/2012 | Alelov |
| 2012/0231464 | A1 | 9/2012 | Yu et al. |
| 2012/0260927 | A1 | 10/2012 | Liu |
| 2012/0279512 | A1 | 11/2012 | Hon |
| 2012/0318882 | A1 | 12/2012 | Abehasera |
| 2013/0008457 | A1 | 1/2013 | Zheng et al. |
| 2013/0037041 | A1 | 2/2013 | Worm et al. |
| 2013/0056013 | A1 | 3/2013 | Terry et al. |
| 2013/0081625 | A1 | 4/2013 | Rustad et al. |
| 2013/0081642 | A1 | 4/2013 | Safari |
| 2013/0180533 | A1 | 7/2013 | Kim et al. |
| 2013/0192619 | A1 | 8/2013 | Tucker et al. |
| 2013/0255702 | A1 | 10/2013 | Griffith, Jr. et al. |
| 2013/0269720 | A1 | 10/2013 | Stone et al. |
| 2013/0284190 | A1 | 10/2013 | Scatterday et al. |
| 2013/0298905 | A1 | 11/2013 | Levin et al. |
| 2013/0306084 | A1 | 11/2013 | Flick |
| 2013/0319439 | A1 | 12/2013 | Gorelick et al. |
| 2013/0340750 | A1 | 12/2013 | Thorens et al. |
| 2013/0340775 | A1 | 12/2013 | Juster et al. |
| 2014/0000638 | A1 | 1/2014 | Sebastian et al. |
| 2014/0060554 | A1 | 3/2014 | Collett et al. |
| 2014/0060555 | A1 | 3/2014 | Chang et al. |
| 2014/0096781 | A1 | 4/2014 | Sears et al. |
| 2014/0096782 | A1 | 4/2014 | Ampolini et al. |
| 2014/0109921 | A1 | 4/2014 | Chen |
| 2014/0157583 | A1 | 6/2014 | Ward et al. |
| 2014/0209105 | A1 | 7/2014 | Sears et al. |
| 2014/0253144 | A1 | 9/2014 | Novak et al. |
| 2014/0261408 | A1 | 9/2014 | DePiano et al. |
| 2014/0261486 | A1 | 9/2014 | Potter et al. |
| 2014/0261487 | A1 | 9/2014 | Chapman et al. |
| 2014/0261495 | A1 | 9/2014 | Novak et al. |
| 2014/0270727 | A1 | 9/2014 | Ampolini et al. |
| 2014/0270729 | A1 | 9/2014 | DePiano et al. |
| 2014/0270730 | A1 | 9/2014 | DePiano et al. |
| 2014/0299125 | A1 | 10/2014 | Buchberger |
| 2014/0299135 | A1 | 10/2014 | Besso et al. |
| 2014/0345631 | A1 | 11/2014 | Bowen et al. |
| 2015/0007838 | A1 | 1/2015 | Fernando et al. |
| 2015/0027454 | A1 | 1/2015 | Li et al. |
| 2015/0027469 | A1 | 1/2015 | Tucker et al. |
| 2015/0040924 | A1 | 2/2015 | Mironov et al. |
| 2015/0053217 | A1 | 2/2015 | Steingraber et al. |
| 2015/0059780 | A1 | 3/2015 | Davis et al. |
| 2015/0083150 | A1 | 3/2015 | Conner et al. |
| 2015/0196059 | A1 | 7/2015 | Liu |
| 2015/0257447 | A1 | 9/2015 | Sullivan |
| 2015/0335070 | A1 | 11/2015 | Sears et al. |
| 2016/0037826 | A1 | 2/2016 | Hearn et al. |
| 2016/0073695 | A1 | 3/2016 | Sears et al. |
| 2016/0143360 | A1 | 5/2016 | Sanchez et al. |
| 2017/0065000 | A1 | 3/2017 | Sears et al. |
| 2018/0154103 | A1 | 6/2018 | Davis |
| 2019/0200673 | A1* | 7/2019 | Bless ..... A24F 47/008 |

FOREIGN PATENT DOCUMENTS

| | | |
|---|---|---|
| CA | 2940842 | 9/2015 |
| CN | 1541577 | 11/2004 |
| CN | 2719043 | 8/2005 |
| CN | 200997909 | 1/2008 |
| CN | 101116542 | 2/2008 |
| CN | 101176805 | 5/2008 |
| CN | 201379072 | 1/2010 |
| DE | 10 2006 004 484 | 8/2007 |
| DE | 102006041042 | 3/2008 |
| DE | 102007011120 | 9/2008 |
| DE | 20 2009 010 400 | 11/2009 |
| EP | 0 295 122 | 12/1988 |
| EP | 0 430 566 | 6/1991 |
| EP | 0503767 | 9/1992 |
| EP | 0 845 220 | 6/1998 |
| EP | 1 618 803 | 1/2006 |
| EP | 2 316 286 | 5/2011 |
| EP | 2989912 | 3/2016 |
| EP | 3061357 | 8/2016 |
| EP | 3153033 | 4/2017 |
| GB | 2469850 | 11/2010 |
| GB | 2511303 | 9/2014 |
| JP | 63127400 | 9/2014 |
| KR | 20130052119 | 5/2013 |
| WO | WO 1997/48293 | 12/1997 |
| WO | WO 2003/034847 | 5/2003 |
| WO | WO 2004/043175 | 5/2004 |
| WO | WO 2004/080216 | 9/2004 |
| WO | WO 2005/099494 | 10/2005 |
| WO | WO 2007/078273 | 7/2007 |
| WO | WO 2007/131449 | 11/2007 |
| WO | WO 2009/105919 | 9/2009 |
| WO | WO 2009/155734 | 12/2009 |
| WO | WO 2010/003480 | 1/2010 |
| WO | WO 2010/045670 | 4/2010 |
| WO | WO 2010/073122 | 7/2010 |
| WO | WO 2010/118644 | 10/2010 |
| WO | WO 2010/140937 | 12/2010 |
| WO | WO 2011/010334 | 1/2011 |
| WO | WO2011117759 | 9/2011 |
| WO | WO 2012/072762 | 6/2012 |
| WO | WO 2012/100523 | 8/2012 |
| WO | WO 2013/089551 | 6/2013 |
| WO | WO2013149404 | 10/2013 |
| WO | WO2014032276 | 3/2014 |
| WO | WO2014116974 | 7/2014 |
| WO | WO2015179388 | 11/2015 |
| WO | WO2016145072 | 9/2016 |
| WO | WO2017089939 | 6/2017 |

* cited by examiner

AEROSOL DELIVERY DEVICE PROVIDING FLAVOR CONTROL

CROSS-REFERENCE TO RELATED APPLICATIONS

This application is a continuation of U.S. patent application Ser. No. 15/858,193, filed on Dec. 29, 2017, which is incorporated herein in its entirety by reference.

FIELD OF THE DISCLOSURE

The present disclosure relates to aerosol delivery devices, and more particularly to an aerosol delivery device that include a reservoir and a vaporizing assembly, which may utilize electrical power to heat an aerosol precursor composition for the production of an aerosol. The aerosol precursor composition, which may incorporate materials and/or components that may be made or derived from tobacco or otherwise incorporate tobacco, is heated by the vaporizing assembly to produce an inhalable substance for human consumption.

BACKGROUND

Many smoking articles have been proposed through the years as improvements upon, or alternatives to, smoking products based upon combusting tobacco. Exemplary alternatives have included devices wherein a solid or liquid fuel is combusted to transfer heat to tobacco or wherein a chemical reaction is used to provide such heat source. Examples include the smoking articles described in U.S. Pat. No. 9,078,473 to Worm et al., which is incorporated herein by reference.

The point of the improvements or alternatives to smoking articles typically has been to provide the sensations associated with cigarette, cigar, or pipe smoking, without delivering considerable quantities of incomplete combustion and pyrolysis products. To this end, there have been proposed numerous smoking products, flavor generators, and medicinal inhalers which utilize electrical energy to vaporize or heat a volatile material, or attempt to provide the sensations of cigarette, cigar, or pipe smoking without burning tobacco to a significant degree. See, for example, the various alternative smoking articles, aerosol delivery devices and heat generating sources set forth in the background art described in U.S. Pat. No. 7,726,320 to Robinson et al.; and U.S. Pat. App. Pub. Nos. 2013/0255702 to Griffith, Jr. et al.; and 2014/0096781 to Sears et al., which are incorporated herein by reference. See also, for example, the various types of smoking articles, aerosol delivery devices and electrically powered heat generating sources referenced by brand name and commercial source in U.S. Pat. App. Pub. No. 2015/0220232 to Bless et al., which is incorporated herein by reference. Additional types of smoking articles, aerosol delivery devices and electrically powered heat generating sources referenced by brand name and commercial source are listed in U.S. Pat. App. Pub. No. 2015/0245659 to DePiano et al., which is also incorporated herein by reference in its entirety. Other representative cigarettes or smoking articles that have been described and, in some instances, been made commercially available include those described in U.S. Pat. No. 4,735,217 to Gerth et al.; U.S. Pat. Nos. 4,922,901, 4,947,874, and 4,947,875 to Brooks et al.; U.S. Pat. No. 5,060,671 to Counts et al.; U.S. Pat. No. 5,249,586 to Morgan et al.; U.S. Pat. No. 5,388,594 to Counts et al.; U.S. Pat. No. 5,666,977 to Higgins et al.; U.S. Pat. No. 6,053,176 to Adams et al.; U.S. Pat. No. 6,164,287 to White; U.S. Pat. No. 6,196,218 to Voges; U.S. Pat. No. 6,810,883 to Felter et al.; U.S. Pat. No. 6,854,461 to Nichols; U.S. Pat. No. 7,832,410 to Hon; U.S. Pat. No. 7,513,253 to Kobayashi; U.S. Pat. No. 7,726,320 to Robinson et al.; U.S. Pat. No. 7,896,006 to Hamano; U.S. Pat. No. 6,772,756 to Shayan; U.S. Pat. App. Pub. No. 2009/0095311 to Hon; U.S. Pat. App. Pub. Nos. 2006/0196518, 2009/0126745, and 2009/0188490 to Hon; U.S. Pat. App. Pub. No. 2009/0272379 to Thorens et al.; U.S. Pat. App. Pub. Nos. 2009/0260641 and 2009/0260642 to Monsees et al.; U.S. Pat. App. Pub. Nos. 2008/0149118 and 2010/0024834 to Oglesby et al.; U.S. Pat. App. Pub. No. 2010/0307518 to Wang; and WO 2010/091593 to Hon, which are incorporated herein by reference.

Representative products that resemble many of the attributes of traditional types of cigarettes, cigars or pipes have been marketed as ACCORD® by Philip Morris Incorporated; ALPHA™, JOYE 510™ and M4™ by InnoVapor LLC; CIRRUS™ and FLING™ by White Cloud Cigarettes; BLU™ by Lorillard Technologies, Inc.; COHITA™, COLIBRI™, ELITE CLASSIC™, MAGNUM™, PHANTOM™ and SENSET™ by EPUFFER® International Inc.; DUOPRO™, STORM™ and VAPORKING® by Electronic Cigarettes, Inc.; EGAR™ by Egar Australia; eGo-C™ and eGo-T™ by Joyetech; ELUSION™ by Elusion UK Ltd; EONSMOKE® by Eonsmoke LLC; FIN™ by FIN Branding Group, LLC; SMOKE® by Green Smoke Inc. USA; GREENARETTE™ by Greenarette LLC; HALLIGAN™ HENDU™ JET™, MAXXQ™ PINK™ and PITBULL™ by SMOKE STIK®; HEATBAR™ by Philip Morris International, Inc.; HYDRO IMPERIAL™ and LXE™ from Crown7; LOGIC™ and THE CUBAN™ by LOGIC Technology; LUCI by Luciano Smokes Inc.; METRO® by Nicotek, LLC; NJOY® and ONEJOY™ by Sottera, Inc.; NO. 7™ by SS Choice LLC; PREMIUM ELECTRONIC CIGARETTE™ by PremiumEstore LLC; RAPP E-MY-STICK™ by Ruyan America, Inc.; RED DRAGON™ by Red Dragon Products, LLC; RUYAN® by Ruyan Group (Holdings) Ltd.; SF® by Smoker Friendly International, LLC; GREEN SMART SMOKER® by The Smart Smoking Electronic Cigarette Company Ltd.; SMOKE ASSIST® by Coastline Products LLC; SMOKING EVERYWHERE® by Smoking Everywhere, Inc.; V2CIGS™ by VMR Products LLC; VAPOR NINE™ by VaporNine LLC; VAPOR4LIFE® by Vapor 4 Life, Inc.; VEPPO™ by E-CigaretteDirect, LLC; VUSE® by R. J. Reynolds Vapor Company; Mistic Menthol product by Mistic Ecigs; and the Vype product by CN Creative Ltd. Yet other electrically powered aerosol delivery devices, and in particular those devices that have been characterized as so-called electronic cigarettes, have been marketed under the tradenames COOLER VISIONS™; DIRECT E-CIG™; DRAGONFLY™; EMIST™; EVERSMOKE™; GAMUCCI®; HYBRID FLAME™; KNIGHT STICKS™; ROYAL BLUES™; SMOKETIP®; SOUTH BEACH SMOKE™.

Certain existing embodiments of aerosol delivery devices include a control body (i.e., a power source assembly) and cartridge (i.e., a reservoir housing). A power source (e.g., a battery) may be positioned in the control body, and an aerosol precursor composition may be retained and/or stored within the cartridge. It would be desirable to provide a cartridge capable of adding one or more flavor additives to the aerosol precursor composition as desired by the user.

SUMMARY OF THE DISCLOSURE

In various implementations, the present disclosure provides an aerosol delivery device configured to produce aerosol. In one implementation, the aerosol delivery device may comprise a control body, a cartridge, and an atomizer configured to receive an aerosol precursor composition and produce an aerosol. The cartridge may comprise a reservoir tank configured to contain an aerosol precursor composition, a masking disc proximate the aerosol precursor composition, the masking disc including an opening configured to the permit aerosol precursor composition to pass therethrough, and a flavor disc proximate the masking disc, the flavor disc including two or more separate sections, wherein at least two of the sections may be configured to permit the aerosol precursor composition to pass therethrough, and at least one of the sections may comprise a flavor section that contains a flavorant. At least one of the masking disc or the flavor disc may be configured to be rotated relative to the other to align the opening of the masking disc with a selected section of the flavor disc so as to allow the aerosol precursor composition to flow from the reservoir tank through the opening of the masking disc and the selected section of the flavor disc to the atomizer such that, when the flavor section is selected, the flavorant is imparted to the aerosol precursor composition delivered to the atomizer.

In some implementations, the flavor disc may further comprise a solid section configured to block the flow of the aerosol precursor composition when the opening of the masking disc is aligned therewith. Some implementations may further comprise a cartridge base that includes two or more passageways, wherein each passageway may be configured to align with a separate section of the flavor disc so as to facilitate flow of the aerosol precursor composition from the reservoir tank through the selected flavor disc section and to the atomizer. In some implementations, the masking disc may be affixed to the reservoir tank, and the reservoir tank may be configured to be rotated so as to rotate the masking disc to align the opening of the masking disc with a selected section of the flavor disc. In some implementations, the reservoir tank may comprise a housing that includes a liquid cavity defined therein, and the liquid cavity may be configured to contain the aerosol precursor composition. In some implementations, the cartridge may define a mouth end and a connecting end, and the connecting end may include a threaded portion configured to thread into an engaging end of the control body.

In some implementations, the flavor disc may include at least three separate sections, wherein one of the sections may comprise a solid section, at least two other sections may comprise flavor sections, and at least two of the flavor sections may contain different flavorants. In some implementations, the flavor disc may include nine separate sections, wherein one of the sections may comprise a solid section, the eight other sections may comprise flavor sections, and each of the flavor sections may contain a different flavorant. Some implementations may further comprise a cartridge base that includes eight passageways, wherein each passageway may be configured to align with a separate respective flavor section of the flavor disc so as to facilitate flow of the aerosol precursor composition from the reservoir tank through a selected flavor section and to the atomizer. In some implementations, the flavor section of the flavor disc may comprise an outer shell defining an inner surface that surrounds an inner chamber, wherein the outer shell may comprise a porous material that contains the flavorant, and the inner chamber may be configured to allow the aerosol precursor composition to flow therethrough against the inner surface.

In various one implementations, the present disclosure also provides a cartridge for use in an aerosol delivery device. In one implementation, the cartridge may comprise a reservoir tank configured to contain an aerosol precursor composition, a masking disc proximate the aerosol precursor composition, the masking disc including an opening configured to the permit aerosol precursor composition to pass therethrough, and a flavor disc proximate the masking disc, the flavor disc including two or more separate sections, wherein at least two of the sections may be configured to permit the aerosol precursor composition to pass therethrough, and at least one of the sections may comprise a flavor section that contains a flavorant, and wherein at least one of the masking disc or the flavor disc may be configured to be rotated relative to the other to align the opening of the masking disc with a selected section of the flavor disc so as to allow the aerosol precursor composition to flow from the reservoir tank through the opening of the masking disc and the selected section of the flavor disc, such that, when the flavor section is selected, a flavor from the flavorant is imparted to the aerosol precursor composition.

In some implementations, the flavor disc may further comprise a solid section configured to block the flow of the aerosol precursor composition when then opening of the masking disc is aligned therewith. Some implementations may further comprise a cartridge base that includes two or more passageways, wherein each passageway may be configured to align with a separate section of the flavor disc so as to facilitate flow of the aerosol precursor composition from the reservoir tank through the selected flavor disc section. In some implementations, the masking disc may be affixed to the reservoir tank, and the reservoir tank may be configured to be rotated so as to rotate the masking disc to align the opening of the masking disc with a selected section of the flavor disc. In some implementations, the reservoir tank may comprise a housing that includes liquid cavity defined therein, and the liquid cavity may be configured to contain the aerosol precursor composition. Some implementations may further comprise a mouth end and a connecting end, and the connecting end may include a threaded portion.

In some implementations, the flavor disc may include at least three separate sections, wherein one of the sections may comprise a solid section, at least two other sections may comprise flavor sections, and at least two of the flavor sections may contain different flavorants. In some implementations, the flavor disc may include nine separate sections, wherein one of the sections may comprise a solid section, and the eight other sections may comprise flavor sections, and each of the flavor sections may contain a different flavorant. Some implementations may further comprise a cartridge base that includes eight passageways, wherein each passageway may be configured to align with a separate respective flavor section of the flavor disc so as to facilitate flow of the aerosol precursor composition from the reservoir tank through a selected flavor section. In some implementations, the flavor section of the flavor disc may comprise an outer shell defining an inner surface that surrounds an inner chamber, wherein the outer shell may comprise a porous material that contains the flavorant, and the inner chamber may be configured to allow the aerosol precursor composition to flow therethrough against the inner surface.

It will be appreciated that the above Summary is provided merely for purposes of summarizing some example aspects so as to provide a basic understanding of some aspects of the disclosure. As such, it will be appreciated that the above described example aspects are merely examples of some aspects and should not be construed to narrow the scope or spirit of the disclosure in any way. It will be appreciated that the scope of the disclosure encompasses many potential aspects, some of which will be further described below, in addition to those here summarized. Further, other features, aspects, and advantages of the disclosure will be apparent from a reading of the following detailed description taken in conjunction with the accompanying drawings which illustrate, by way of example, the principles of the described aspects.

BRIEF DESCRIPTION OF THE FIGURES

In order to assist the understanding of aspects of the disclosure, reference will now be made to the appended drawings, which are not necessarily drawn to scale and in which like reference numerals refer to like elements. The drawings are exemplary only, and should not be construed as limiting the disclosure.

DETAILED DESCRIPTION

Figure 1:
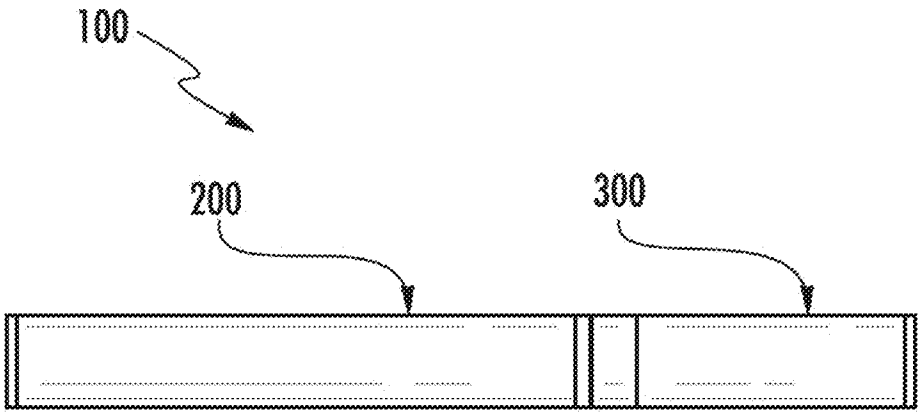
FIG. 1 illustrates a side view of an aerosol delivery device comprising a cartridge and a control body in an assembled configuration, according to an example implementation of the present disclosure.

The present disclosure will now be described more fully hereinafter with reference to exemplary embodiments thereof. These exemplary embodiments are described so that this disclosure will be thorough and complete, and will fully convey the scope of the disclosure to those skilled in the art. Indeed, the disclosure may be embodied in many different forms and should not be construed as limited to the embodiments set forth herein; rather, these embodiments are provided so that this disclosure will satisfy applicable legal requirements. As used in the specification, and in the appended claims, the singular forms "a", "an", "the", include plural variations unless the context clearly dictates otherwise.

The present disclosure provides descriptions of aerosol delivery devices. The aerosol delivery devices may use electrical energy to heat a material to form an inhalable substance; such articles most preferably being sufficiently compact to be considered "hand-held" devices. An aerosol delivery device may provide some or all of the sensations (e.g., inhalation and exhalation rituals, types of tastes or flavors, organoleptic effects, physical feel, use rituals, visual cues such as those provided by visible aerosol, and the like) of smoking a cigarette, cigar, or pipe, without any substantial degree of combustion of any component of that article or device. The aerosol delivery device may not produce smoke in the sense of the aerosol resulting from by-products of combustion or pyrolysis of tobacco, but rather, that the article or device most preferably yields vapors (including vapors within aerosols that can be considered to be visible aerosols that might be considered to be described as smoke-like) resulting from volatilization or vaporization of certain components of the article or device, although in other implementations the aerosol may not be visible. In some implementations, aerosol delivery devices may incorporate tobacco and/or components derived from tobacco. As such, the aerosol delivery device can be characterized as an electronic smoking article such as an electronic cigarette or "e-cigarette."

While the systems are generally described herein in terms of implementations associated with aerosol delivery devices such as so-called "e-cigarettes," it should be understood that the mechanisms, components, features, and methods may be embodied in many different forms and associated with a variety of articles. For example, the description provided herein may be employed in conjunction with implementations of traditional smoking articles (e.g., cigarettes, cigars, pipes, etc.), heat-not-burn cigarettes, and related packaging for any of the products disclosed herein. Accordingly, it should be understood that the description of the mechanisms, components, features, and methods disclosed herein are discussed in terms of embodiments relating to aerosol delivery devices by way of example only, and may be embodied and used in various other products and methods.

Aerosol delivery devices of the present disclosure also can be characterized as being vapor-producing articles or medicament delivery articles. Thus, such articles or devices can be adapted so as to provide one or more substances (e.g., flavors and/or pharmaceutical active ingredients) in an inhalable form or state. For example, inhalable substances can be substantially in the form of a vapor (i.e., a substance that is in the gas phase at a temperature lower than its critical point). Alternatively, inhalable substances can be in the form of an aerosol (i.e., a suspension of fine solid particles or liquid droplets in a gas). For purposes of simplicity, the term "aerosol" as used herein is meant to include vapors, gases and aerosols of a form or type suitable for human inhalation, whether or not visible, and whether or not of a form that might be considered to be smoke-like.

In use, aerosol delivery devices of the present disclosure may be subjected to many of the physical actions employed by an individual in using a traditional type of smoking article (e.g., a cigarette, cigar or pipe that is employed by lighting and inhaling tobacco). For example, the user of an aerosol delivery device of the present disclosure can hold that article much like a traditional type of smoking article, draw on one end of that article for inhalation of aerosol produced by that article, take puffs at selected intervals of time, etc.

Aerosol delivery devices of the present disclosure generally include a number of components provided within an outer shell or body. The overall design of the outer shell or body can vary, and the format or configuration of the outer body that can define the overall size and shape of the aerosol delivery device can vary. Typically, an elongated body resembling the shape of a cigarette or cigar can be a formed from a single, unitary shell; or the elongated body can be formed of two or more separable pieces. For example, an aerosol delivery device can comprise an elongated shell or body that can be substantially tubular in shape and, as such, resemble the shape of a conventional cigarette or cigar. However, various other shapes and configurations may be employed in other embodiments (e.g., rectangular or fob-shaped).

In one implementation, all of the components of the aerosol delivery device are contained within one outer body or shell. Alternatively, an aerosol delivery device can comprise two or more shells that are joined and are separable. For example, an aerosol delivery device can possess at one end a control body comprising a shell containing one or more reusable components (e.g., a rechargeable battery and various electronics for controlling the operation of that article), and at the other end and removably attached thereto a shell containing a disposable portion (e.g., a disposable flavor-containing cartridge). More specific formats, configurations and arrangements of components within the single shell type of unit or within a multi-piece separable shell type of unit will be evident in light of the further disclosure provided herein. Additionally, various aerosol delivery device designs and component arrangements can be appreciated upon consideration of the commercially available electronic aerosol delivery devices.

Aerosol delivery devices of the present disclosure most preferably comprise some combination of a power source (i.e., an electrical power source), at least one control component (e.g., means for actuating, controlling, regulating and/or ceasing power for heat generation, such as by controlling electrical current flow from the power source to other components of the aerosol delivery device), a heater or heat generation component (e.g., an electrical resistance heating element or component commonly referred to as part of an "atomizer"), and an aerosol precursor composition (e.g., commonly a liquid capable of yielding an aerosol upon application of sufficient heat, such as ingredients commonly referred to as "smoke juice," "e-liquid" and "e-juice"), and a mouth end region or tip for allowing draw upon the aerosol delivery device for aerosol inhalation (e.g., a defined air flow path through the article such that aerosol generated can be withdrawn therefrom upon draw).

Alignment of the components within the aerosol delivery device of the present disclosure can vary. In specific implementations, the aerosol precursor composition can be located near an end of the aerosol delivery device which may be configured to be positioned proximal to the mouth of a user so as to maximize aerosol delivery to the user. Other configurations, however, are not excluded. Generally, the heating element can be positioned sufficiently near the aerosol precursor composition so that heat from the heating element can volatilize the aerosol precursor (as well as one or more flavorants, medicaments, or the like that may likewise be provided for delivery to a user) and form an aerosol for delivery to the user. When the heating element heats the aerosol precursor composition, an aerosol is formed, released, or generated in a physical form suitable for inhalation by a consumer. It should be noted that the foregoing terms are meant to be interchangeable such that reference to release, releasing, releases, or released includes form or generate, forming or generating, forms or generates, and formed or generated. Specifically, an inhalable substance is released in the form of a vapor or aerosol or mixture thereof, wherein such terms are also interchangeably used herein except where otherwise specified.

As noted above, the aerosol delivery device may incorporate a battery and/or other electrical power source (e.g., a capacitor) to provide current flow sufficient to provide various functionalities to the aerosol delivery device, such as powering of a heater, powering of control systems, powering of indicators, and the like. The power source can take on various implementations. Preferably, the power source is able to deliver sufficient power to rapidly heat the heating element to provide for aerosol formation and power the aerosol delivery device through use for a desired duration of time. The power source is preferably sized to fit conveniently within the aerosol delivery device so that the aerosol delivery device can be easily handled. Additionally, a preferred power source is of a sufficiently light weight to not detract from a desirable smoking experience.

More specific formats, configurations and arrangements of components within the aerosol delivery device of the present disclosure will be evident in light of the further disclosure provided hereinafter. Additionally, the selection of various aerosol delivery device components can be appreciated upon consideration of the commercially available electronic aerosol delivery devices. Further, the arrangement of the components within the aerosol delivery device can also be appreciated upon consideration of the commercially available electronic aerosol delivery devices. Examples of commercially available products, for which the components thereof, methods of operation thereof, materials included therein, and/or other attributes thereof may be included in the devices of the present disclosure as well as manufacturers, designers, and/or assignees of components and related technologies that may be employed in the aerosol delivery device of the present disclosure are described in U.S. patent application Ser. No. 15/222,615, filed Jul. 28, 2016, to Watson et al., which is incorporated herein by reference in its entirety.

One example implementation of an aerosol delivery device 100 is illustrated in FIG. 1. In particular, FIG. 1 illustrates an aerosol delivery device 100 including a control body 200 and a cartridge 300. The control body 200 and the cartridge 300 can be permanently or detachably aligned in a functioning relationship. Various mechanisms may connect the cartridge 300 to the control body 200 to result in a threaded engagement, a press-fit engagement, an interference fit, a magnetic engagement, or the like. The aerosol delivery device 100 may be substantially rod-like, substantially tubular shaped, or substantially cylindrically shaped in some implementations when the cartridge 300 and the control body 200 are in an assembled configuration. However, as noted above, various other configurations such as rectangular or fob-shaped may be employed in other implementations. Further, although the aerosol delivery devices are generally described herein as resembling the size and shape of a traditional smoking article, in other implementations differing configurations and larger capacity reservoirs, which may be referred to as "tanks," may be employed.

In specific implementations, one or both of the cartridge 300 and the control body 200 may be referred to as being disposable or as being reusable. For example, the control body 200 may have a replaceable battery or a rechargeable battery and/or capacitor and thus may be combined with any type of recharging technology, including connection to a typical alternating current electrical outlet, connection to a car charger (i.e., cigarette lighter receptacle), and connection to a computer, such as through a universal serial bus (USB) cable. Further, in some implementations the cartridge 300 may comprise a single-use cartridge, as disclosed in U.S. Pat. No. 8,910,639 to Chang et al., which is incorporated herein by reference in its entirety. For example, the cartridge 300 may include a limited amount of aerosol precursor composition therein to provide for many of the sensations (e.g., inhalation and exhalation rituals, types of tastes or flavors, organoleptic effects, etc.) of smoking a particular amount of traditional types of smoking articles (e.g., cigarettes, cigars, pipes, etc.). In some aspects, the cartridge 300 may include a particular amount of aerosol precursor composition therein equivalent to the amount of traditional types of smoking articles one would consume to obtain the sensations of smoking a typical amount of traditional types of smoking articles (e.g., a typical package of cigarettes—i.e., twenty (20) cigarettes).

Figure 2:
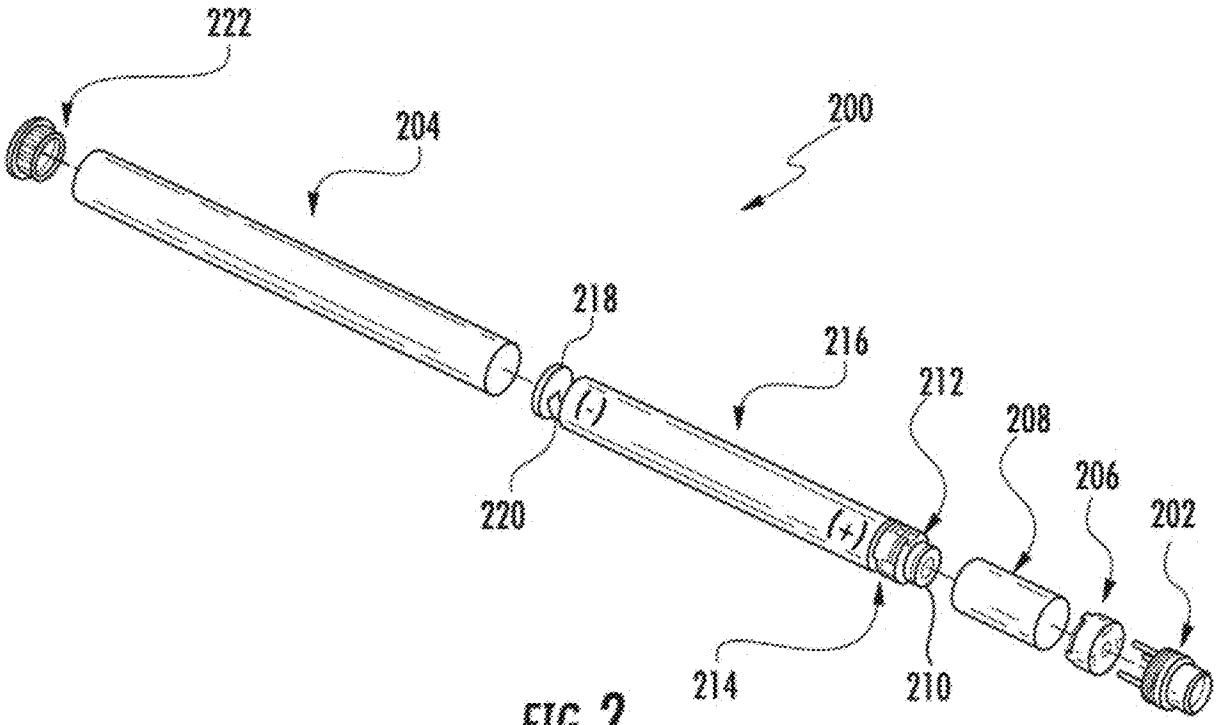
FIG. 2 illustrates an exploded perspective view of the control body of FIG. 1, according to an example implementation of the present disclosure.

FIG. 2 illustrates an exploded view of the control body 200 of the aerosol delivery device 100 (see, FIG. 1) according to an example implementation of the present disclosure. As illustrated, the control body 200 may comprise a coupler 202, an outer body 204, a sealing member 206, an adhesive member 208 (e.g., KAPTON® tape), a flow sensor 210 (e.g., a puff sensor or pressure switch), a control component 212, a spacer 214, an electrical power source 216 (e.g., a capacitor and/or a battery, which may be rechargeable), a circuit board with an indicator 218 (e.g., a light emitting diode (LED)), a connector circuit 220, and an end cap 222. Examples of electrical power sources are described in U.S. Pat. No. 9,484,155 to Peckerar et al., the disclosure of which is incorporated herein by reference in its entirety.

With respect to the flow sensor 210, representative current regulating components and other current controlling components including various microcontrollers, sensors, and switches for aerosol delivery devices are described in U.S. Pat. No. 4,735,217 to Gerth et al., U.S. Pat. Nos. 4,922,901, 4,947,874, and 4,947,875, all to Brooks et al., U.S. Pat. No. 5,372,148 to McCafferty et al., U.S. Pat. No. 6,040,560 to Fleischhauer et al., U.S. Pat. No. 7,040,314 to Nguyen et al., and U.S. Pat. No. 8,205,622 to Pan, all of which are incorporated herein by reference in their entireties. Reference also is made to the control schemes described in U.S. Pat. No. 9,423,152 to Ampolini et al., which is incorporated herein by reference in its entirety.

In one implementation the indicator 218 may comprise one or more light emitting diodes. The indicator 218 can be in communication with the control component 212 through the connector circuit 220 and be illuminated, for example, during a user draw on a cartridge coupled to the coupler 202, as detected by the flow sensor 210. The end cap 222 may be adapted to make visible the illumination provided thereunder by the indicator 218. Accordingly, the indicator 218 may be illuminated during use of the aerosol delivery device 100 to simulate the lit end of a smoking article. However, in other implementations the indicator 218 can be provided in varying numbers and can take on different shapes and can even be an opening in the outer body (such as for release of sound when such indicators are present).

Still further components can be utilized in the aerosol delivery device of the present disclosure. For example, U.S. Pat. No. 5,154,192 to Sprinkel et al. discloses indicators for smoking articles; U.S. Pat. No. 5,261,424 to Sprinkel, Jr. discloses piezoelectric sensors that can be associated with the mouth-end of a device to detect user lip activity associated with taking a draw and then trigger heating of a heating device; U.S. Pat. No. 5,372,148 to McCafferty et al. discloses a puff sensor for controlling energy flow into a heating load array in response to pressure drop through a mouthpiece; U.S. Pat. No. 5,967,148 to Harris et al. discloses receptacles in a smoking device that include an identifier that detects a non-uniformity in infrared transmissivity of an inserted component and a controller that executes a detection routine as the component is inserted into the receptacle; U.S. Pat. No. 6,040,560 to Fleischhauer et al. describes a defined executable power cycle with multiple differential phases; U.S. Pat. No. 5,934,289 to Watkins et al. discloses photonic-optronic components; U.S. Pat. No. 5,954,979 to Counts et al. discloses means for altering draw resistance through a smoking device; U.S. Pat. No. 6,803,545 to Blake et al. discloses specific battery configurations for use in smoking devices; U.S. Pat. No. 7,293,565 to Griffen et al. discloses various charging systems for use with smoking devices; U.S. Pat. No. 8,402,976 to Fernando et al. discloses computer interfacing means for smoking devices to facilitate charging and allow computer control of the device; U.S. Pat. No. 8,689,804 to Fernando et al. discloses identification systems for smoking devices; and WO 2010/003480 by Flick discloses a fluid flow sensing system indicative of a puff in an aerosol generating system; all of the foregoing disclosures being incorporated herein by reference in their entireties. Further examples of components related to electronic aerosol delivery articles and disclosing materials or components that may be used in the present article include U.S. Pat. No. 4,735,217 to Gerth et al.; U.S. Pat. No. 5,249,586 to Morgan et al.; U.S. Pat. No. 5,666,977 to Higgins et al.; U.S. Pat. No. 6,053,176 to Adams et al.; U.S. Pat. No. 6,164,287 to White; U.S. Pat. No. 6,196,218 to Voges; U.S. Pat. No. 6,810,883 to Felter et al.; U.S. Pat. No. 6,854,461 to Nichols; U.S. Pat. No. 7,832,410 to Hon; U.S. Pat. No. 7,513,253 to Kobayashi; U.S. Pat. No. 7,896,006 to Hamano; U.S. Pat. No. 6,772,756 to Shayan; U.S. Pat. Nos. 8,156,944 and 8,375,957 to Hon; U.S. Pat. No. 8,794,231 to Thorens et al.; U.S. Pat. No. 8,851,083 to Oglesby et al.; U.S. Pat. Nos. 8,915,254 and 8,925,555 to Monsees et al.; and U.S. Pat. No. 9,220,302 to DePiano et al.; U.S. Pat. App. Pub. Nos. 2006/0196518 and 2009/0188490 to Hon; U.S. Pat. App. Pub. No. 2010/0024834 to Oglesby et al.; U.S. Pat. App. Pub. No. 2010/0307518 to Wang; WO 2010/091593 to Hon; and WO 2013/089551 to Foo, each of which is incorporated herein by reference in its entirety. A variety of the materials disclosed by the foregoing documents may be incorporated into the present devices in various embodiments, and all of the foregoing disclosures are incorporated herein by reference in their entireties.

Figure 3:
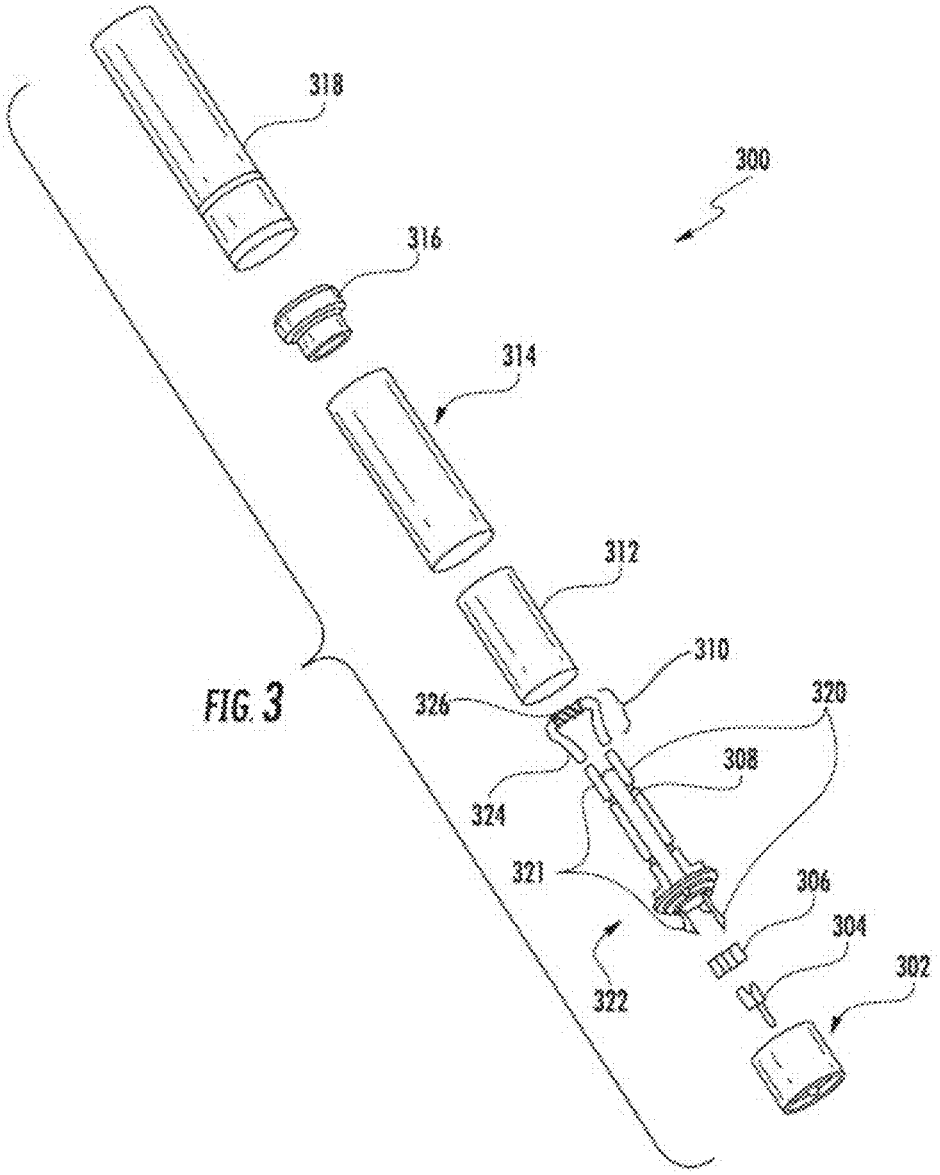
FIG. 3 illustrates an exploded perspective view of the cartridge of FIG. 1, according to an example implementation of the present disclosure.

FIG. 3 illustrates the cartridge 300 of the aerosol delivery device 100 (see, FIG. 1) in an exploded configuration. As illustrated, the cartridge 300 may comprise a base 302, a control component terminal 304, an electronic component 306, a flow director 308, an atomizer 310, a reservoir 312 (e.g., a reservoir substrate), an outer body 314, a mouthpiece 316, a label 318, and first and second heating terminals 320, 321 according to an example embodiment of the present disclosure.

In some implementations the first and second heating terminals 320, 321 may be embedded in, or otherwise coupled to, the flow director 308. For example, the first and second heating terminals 320, 321 may be insert molded in the flow director 308. Accordingly, the flow director 308 and the first and second heating terminals are collectively referred to herein as a flow director assembly 322. Additional description with respect to the first and second heating terminals 320, 321 and the flow director 308 is provided in U.S. Pat. Pub. No. 2015/0335071 to Brinkley et al., which is incorporated herein by reference in its entirety.

The atomizer 310 of the depicted implementation may comprise a liquid transport element 324 and a heating element 326. The cartridge may additionally include a base shipping plug engaged with the base and/or a mouthpiece shipping plug engaged with the mouthpiece in order to protect the base and the mouthpiece and prevent entry of contaminants therein prior to use as disclosed, for example, in U.S. Pat. No. 9,220,302 to Depiano et al., which is incorporated herein by reference in its entirety.

The base 302 may be coupled to a first end of the outer body 314 and the mouthpiece 316 may be coupled to an opposing second end of the outer body to substantially or fully enclose other components of the cartridge 300 therein. For example, the control component terminal 304, the electronic component 306, the flow director 308, the atomizer 310, and the reservoir 312 may be substantially or entirely retained within the outer body 314. The label 318 may at least partially surround the outer body 314, and optionally the base 302, and include information such as a product identifier thereon. The base 302 may be configured to engage the coupler 202 of the control body 200 (see, e.g., FIG. 2). In some implementations the base 302 may comprise anti-rotation features that substantially prevent relative rotation between the cartridge and the control body as disclosed in U.S. Pat. App. Pub. No. 2014/0261495 to Novak et al., which is incorporated herein by reference in its entirety.

The reservoir 312 may be configured to hold an aerosol precursor composition. Some representative types of aerosol precursor components and formulations are also set forth and characterized in U.S. Pat. No. 7,726,320 to Robinson et al., U.S. Pat. No. 8,881,737 to Collett et al., and U.S. Pat. No. 9,254,002 to Chong et al.; and U.S. Pat. Pub. Nos. 2013/0008457 to Zheng et al.; 2015/0020823 to Lipowicz et al.; and 2015/0020830 to Koller, as well as WO 2014/182736 to Bowen et al, the disclosures of which are incorporated herein by reference. Other aerosol precursors that may be employed include the aerosol precursors that have been incorporated in the VUSE® product by R. J. Reynolds Vapor Company, the BLU product by Lorillard Technologies, the MISTIC MENTHOL product by Mistic Ecigs, and the VYPE product by CN Creative Ltd. Also desirable are the so-called "smoke juices" for electronic cigarettes that have been available from Johnson Creek Enterprises LLC. Implementations of effervescent materials can be used with the aerosol precursor, and are described, by way of example, in U.S. Pat. App. Pub. No. 2012/0055494 to Hunt et al., which is incorporated herein by reference. Further, the use of effervescent materials is described, for example, in U.S. Pat. No. 4,639,368 to Niazi et al.; U.S. Pat. No. 5,178,878 to Wehling et al.; U.S. Pat. No. 5,223,264 to Wehling et al.; U.S. Pat. No. 6,974,590 to Pather et al.; U.S. Pat. No. 7,381,667 to Bergquist et al.; U.S. Pat. No. 8,424,541 to Crawford et al; U.S. Pat. No. 8,627,828 to Strickland et al.; and U.S. Pat. No. 9,307,787 to Sun et al.; as well as U.S. Pat. App. Pub. No. 2010/0018539 to Brinkley et al. and PCT WO 97/06786 to Johnson et al., all of which are incorporated by reference herein. Additional description with respect to implementations of aerosol precursor compositions, including description of tobacco or components derived from tobacco included therein, is provided in U.S. patent application Ser. Nos. 15/216,582 and 15/216,590, each filed Jul. 21, 2016 and each to Davis et al., which are incorporated herein by reference in their entireties.

The reservoir 312 may comprise a plurality of layers of nonwoven fibers formed into the shape of a tube encircling the interior of the outer body 314 of the cartridge 300. Thus, liquid components, for example, can be sorptively retained by the reservoir 312. The reservoir 312 is in fluid connection with the liquid transport element 324. Thus, the liquid transport element 324 may be configured to transport liquid from the reservoir 312 to the heating element 326 via capillary action or other liquid transport mechanism.

As illustrated, the liquid transport element 324 may be in direct contact with the heating element 326. As further illustrated in FIG. 3, the heating element 326 may comprise a wire defining a plurality of coils wound about the liquid transport element 324. In some embodiments the heating element 326 may be formed by winding the wire about the liquid transport element 324 as described in U.S. Pat. No. 9,210,738 to Ward et al., which is incorporated herein by reference in its entirety. Further, in some implementations the wire may define a variable coil spacing, as described in U.S. Pat. No. 9,277,770 to DePiano et al., which is incorporated herein by reference in its entirety. Various implementations of materials configured to produce heat when electrical current is applied therethrough may be employed to form the heating element 326. Example materials from which the wire coil may be formed include Kanthal (FeCrAl), Nichrome, Molybdenum disilicide ($MoSi_2$), molybdenum silicide (MoSi), Molybdenum disilicide doped with Aluminum ($Mo(Si,A1)_2$), graphite and graphite-based materials; and ceramic (e.g., a positive or negative temperature coefficient ceramic).

However, various other implementations of methods may be employed to form the heating element 326, and various other implementations of heating elements may be employed in the atomizer 310. For example, a stamped heating element may be employed in the atomizer, as described in U.S. Pat. App. Pub. No. 2014/0270729 to DePiano et al., which is incorporated herein by reference in its entirety. Further to the above, additional representative heating elements and materials for use therein are described in U.S. Pat. No. 5,060,671 to Counts et al.; U.S. Pat. No. 5,093,894 to Deevi et al.; U.S. Pat. No. 5,224,498 to Deevi et al.; U.S. Pat. No. 5,228,460 to Sprinkel Jr., et al.; U.S. Pat. No. 5,322,075 to Deevi et al.; U.S. Pat. No. 5,353,813 to Deevi et al.; U.S. Pat. No. 5,468,936 to Deevi et al.; U.S. Pat. No. 5,498,850 to Das; U.S. Pat. No. 5,659,656 to Das; U.S. Pat. No. 5,498,855 to Deevi et al.; U.S. Pat. No. 5,530,225 to Hajaligol; U.S. Pat. No. 5,665,262 to Hajaligol; U.S. Pat. No. 5,573,692 to Das et al.; and U.S. Pat. No. 5,591,368 to Fleischhauer et al., the disclosures of which are incorporated herein by reference in their entireties. Further, chemical heating may be employed in other implementations. Various additional examples of heaters and materials employed to form heaters are described in U.S. Pat. No. 8,881,737 to Collett et al., which is incorporated herein by reference, as noted above.

A variety of heater components may be used in the present aerosol delivery device. In various implementations, one or more microheaters or like solid state heaters may be used. Microheaters and atomizers incorporating microheaters suitable for use in the presently disclosed devices are described in U.S. Pat. No. 8,881,737 to Collett et al., which is incorporated herein by reference in its entirety.

The first heating terminal 320 and the second heating terminal 321 (e.g., negative and positive heating terminals) are configured to engage opposing ends of the heating element 326 and to form an electrical connection with the control body 200 (see, e.g., FIG. 2) when the cartridge 300 is connected thereto. Further, when the control body 200 is coupled to the cartridge 300, the electronic component 306 may form an electrical connection with the control body through the control component terminal 304. The control body 200 may thus employ the electronic control component 212 (see, FIG. 2) to determine whether the cartridge 300 is genuine and/or perform other functions. Further, various examples of electronic control components and functions performed thereby are described in U.S. Pat. App. Pub. No. 2014/0096781 to Sears et al., which is incorporated herein by reference in its entirety.

During use, a user may draw on the mouthpiece 316 of the cartridge 300 of the aerosol delivery device 100 (see, FIG. 1). This may pull air through an opening in the control body 200 (see, e.g., FIG. 2) or in the cartridge 300. For example, in one implementation an opening may be defined between the coupler 202 and the outer body 204 of the control body 200 (see, e.g., FIG. 2), as described in U.S. Pat. No. 9,220,302 to DePiano et al., which is incorporated herein by reference in its entirety. However, the flow of air may be received through other parts of the aerosol delivery device 100 in other implementations. As noted above, in some implementations the cartridge 300 may include the flow director 308. The flow director 308 may be configured to direct the flow of air received from the control body 200 to the heating element 326 of the atomizer 310.

A sensor in the aerosol delivery device 100 (e.g., the flow sensor 210 in the control body 200; see, FIG. 2) may sense the puff. When the puff is sensed, the control body 200 may direct current to the heating element 326 through a circuit including the first heating terminal 320 and the second heating terminal 321. Accordingly, the heating element 326 may vaporize the aerosol precursor composition directed to an aerosolization zone from the reservoir 312 by the liquid transport element 324. Thus, the mouthpiece 326 may allow passage of air and entrained vapor (i.e., the components of the aerosol precursor composition in an inhalable form) from the cartridge 300 to a consumer drawing thereon.

Various other details with respect to the components that may be included in the cartridge 300 are provided, for example, in U.S. Pat. App. Pub. No. 2014/0261495 to DePiano et al., which is incorporated herein by reference in its entirety. Additional components that may be included in the cartridge 300 and details relating thereto are provided, for example, in U.S. Pat. Pub. No. 2015/0335071 to Brinkley et al., filed May 23, 2014, which is incorporated herein by reference in its entirety.

Various components of an aerosol delivery device according to the present disclosure can be chosen from components described in the art and commercially available. Reference is made for example to the reservoir and heater system for controllable delivery of multiple aerosolizable materials in an electronic smoking article disclosed in U.S. Pat. App. Pub. No. 2014/0000638 to Sebastian et al., which is incorporated herein by reference in its entirety.

In another implementation, substantially the entirety of the cartridge may be formed from one or more carbon materials, which may provide advantages in terms of biodegradability and absence of wires. In this regard, the heating element may comprise carbon foam, the reservoir may comprise carbonized fabric, and graphite may be employed to form an electrical connection with the power source and control component. An example embodiment of a carbon-based cartridge is provided in U.S. Pat. App. Pub. No. 2013/0255702 to Griffith et al., which is incorporated herein by reference in its entirety.

Figure 4:
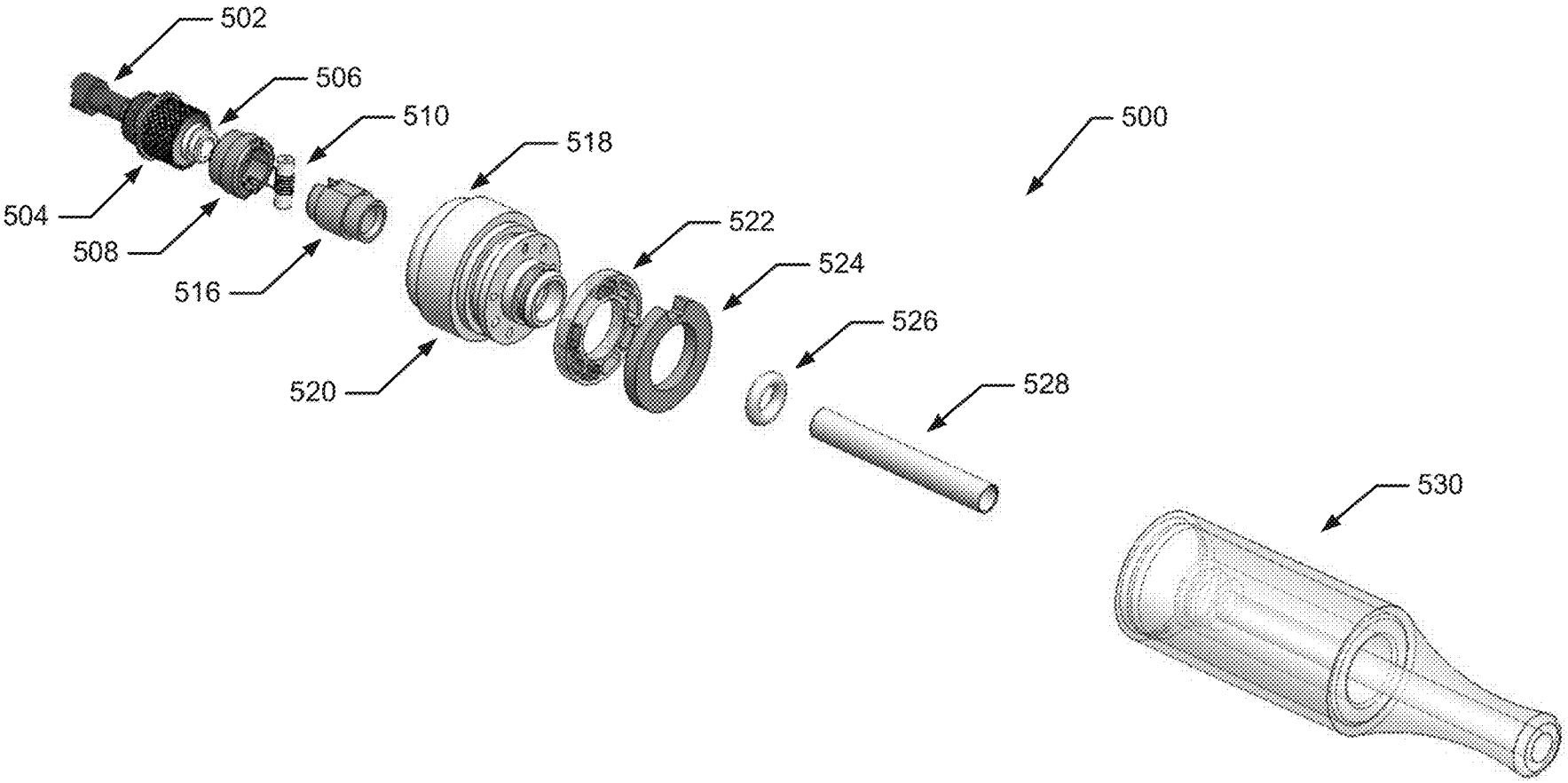
FIG. 4 illustrates an exploded perspective view of a cartridge for use in an aerosol delivery device, according to an example implementation of the present disclosure.
Figure 5:
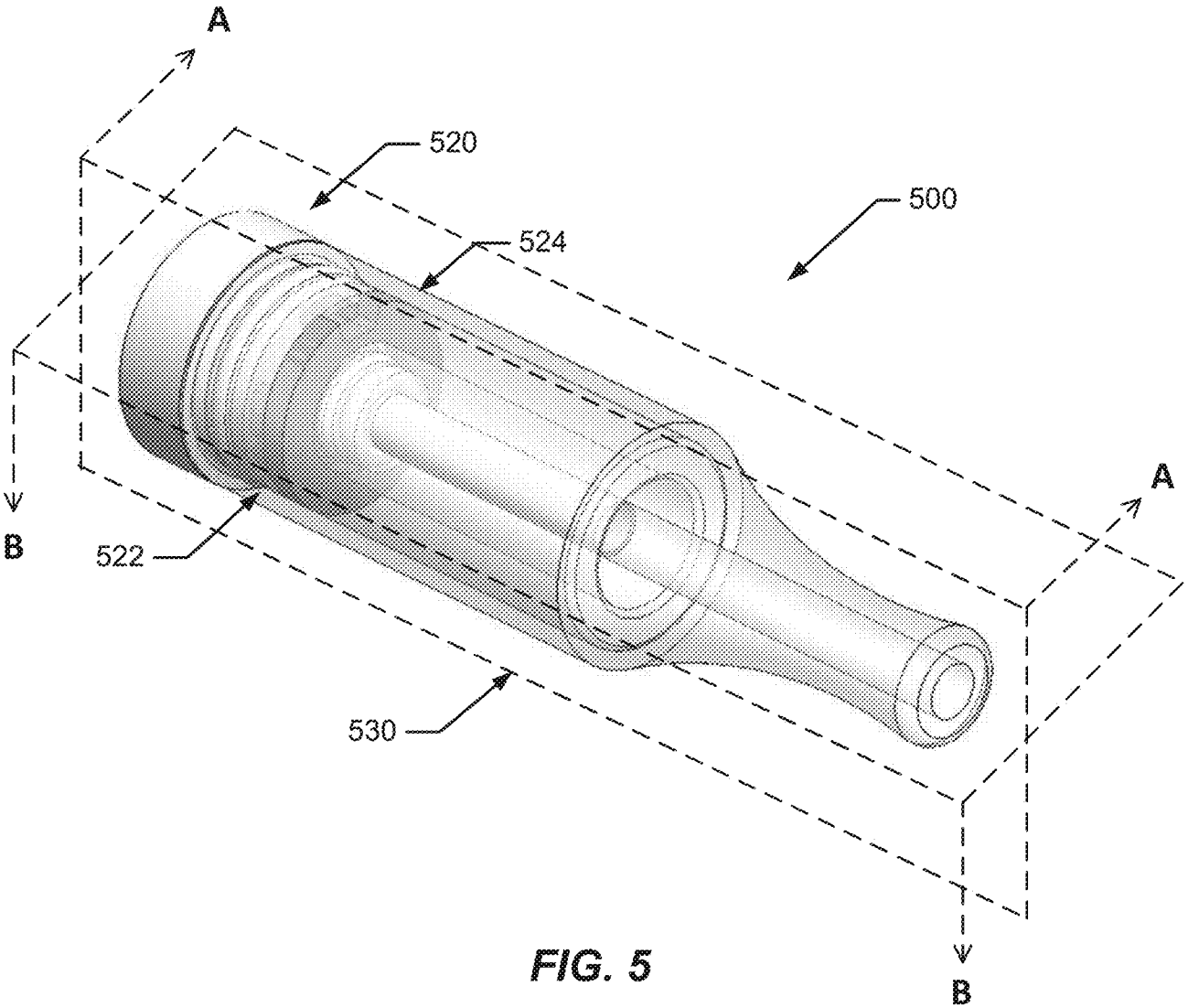
FIG. 5 illustrates a perspective view of the cartridge of FIG. 4 in an assembled configuration, according to an example implementation of the present disclosure.
Figure 6:
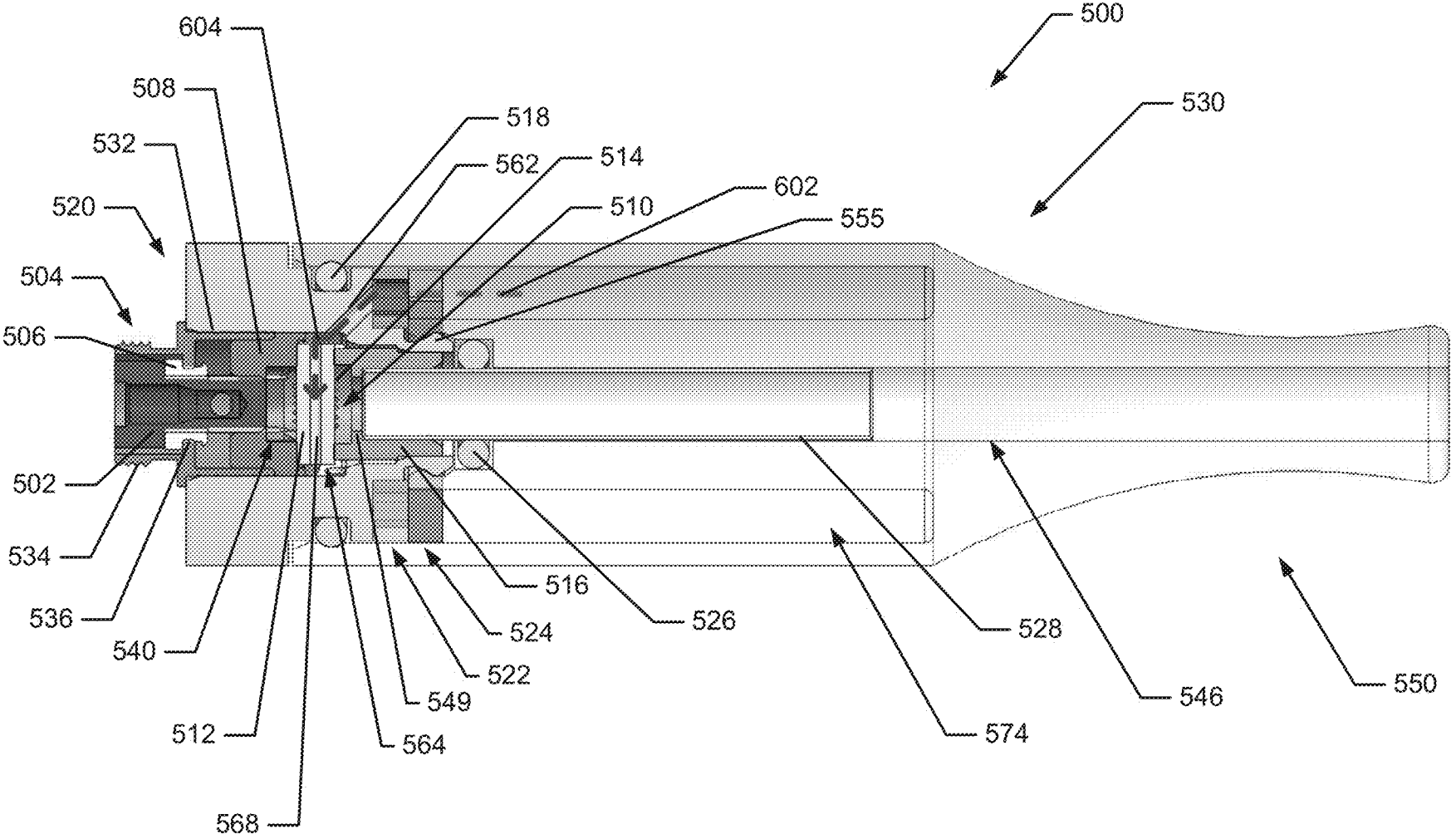
FIG. 6 illustrates a cross-section view of the cartridge of FIG. 5 taken along section line A-A, according to an example implementation of the present disclosure.
Figure 7:
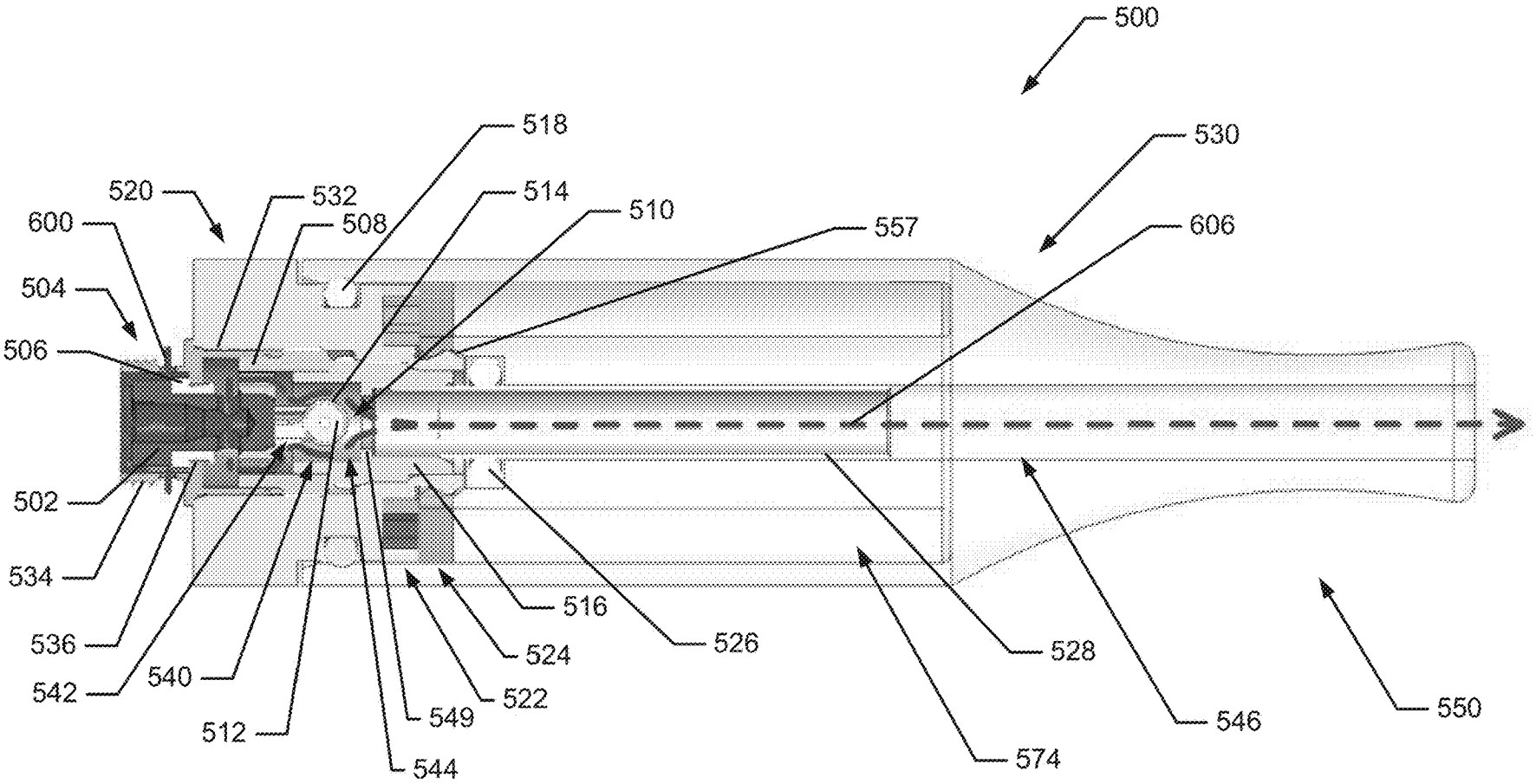
FIG. 7 illustrates a cross-section view of the cartridge of FIG. 5 taken along section line B-B, according to an example implementation of the present disclosure.

However, in some implementations it may be desirable to provide aerosol delivery devices, and in particular, cartridges for use in aerosol delivery devices, with alternative configurations. In this regard, FIG. 4 illustrates an exploded perspective view of a cartridge 500 for use in an aerosol delivery device, according to an example implementation of the present disclosure. FIG. 5 illustrates a perspective view of the cartridge 500 of FIG. 4 in an assembled configuration, according to an example implementation of the present disclosure, FIG. 6 illustrates a cross-section view, taken along section line A-A, of the cartridge 500 of FIG. 5, according to an example implementation of the present disclosure, and FIG. 7 illustrates a cross-section view, taken along section line B-B, of the cartridge 500 of FIG. 5, according to an example implementation of the present disclosure. Where not otherwise described and/or illustrated, components of an aerosol delivery device, an in particular, the control body for use with the illustrated cartridge, may be substantially similar to, or the same as, corresponding components described above.

As illustrated in FIGS. 4-7 and as will be discussed in more detail below, the cartridge 500 of the depicted implementation includes the following components: a center pin 502, a connector 504, an insulating ring 506, a lower atomizer seal 508, an atomizer 510 (which includes a liquid transport element 512 and a heating element 514), an upper atomizer seal 516, a lower base seal 518, a cartridge base 520, a flavor ring 522, a masking ring 524, an upper base seal 526, an aerosol tube 528, and a reservoir tank 530. As illustrated, the cartridge 500 of FIGS. 4-7 may be configured to releasably engage a control body so as to create an aerosol delivery device. In various implementations, the control body may be similar to, or the same as the control body 200 described above (see, FIG. 2), and hence description thereof will not be repeated. It should be noted, however, that in other implementations the control body may differ from that described above. In addition, in some implementations, the control body of the aerosol delivery device may have different shape than that described above, such as, for example, a hand-held fob-shaped control body.

In various implementations, the connector 504 of the cartridge 500 is fixedly attached to the cartridge base 520. For example, in the depicted implementation, the surface 532 of the connector 504 that interfaces with the cartridge base 520 has an outside diameter that is larger than an inside diameter of the cartridge base 520 and includes a knurl pattern created thereon such that when the connector 504 is pressed into the cartridge base 520 (e.g, to create a transition fit or interference fit), the connector 504 and the cartridge base 520 are fixed together. In other implementations, the connector 504 and the cartridge base 520 may be fixedly attached by other means, including, but not limited to, the use of various adhesives, and/or other mechanical attachment means, including, for example, the use of mechanical locking features located on one or both the connector and the cartridge base. As will be discussed in more detail below, in various implementations, the connector 504 may constructed of a conductive material, such as a metal material, and the cartridge base 520 may be constructed of an insulating material, such as a rubber or plastic material. Thus, in some other implementations, a fixed relationship between the connector 504 and the cartridge base 520 may be created by insert molding the connector 504 into the cartridge base 520. In the depicted implementation, the connector is constructed of brass C3604 and is plated with a copper-nickel (CuNi) plating, although in other implementations, other materials, including stainless steel, are possible. In the depicted implementation, the cartridge base 520 is constructed of Tritan™ (a copolymer material), although in other implementations, other materials, including aluminum, are possible.

In the depicted implementation, the connector 504 of the cartridge 500 comprises a male connector, with external threads 534, which are configured to engage corresponding internal threads of a female connector (not shown), which may be part of the control body 200. In other implementations, however, the connector 504 of the cartridge 500 may comprise a female connector and the control body 200 may include a corresponding male connector. In any event, the connector 504 of the cartridge 500 and the corresponding connector of the control body 200 are configured such that, when threaded together and tightened, the cartridge base 520 and the control body 200 do not easily move relative to each other without unscrewing the cartridge 500 from the control body 200. It should be noted that in other implementations, such a relationship may be created using other connecting means. For example, in some implementations, the cartridge base and the control body may be connected using a snap connection and/or a bayonet connection, wherein the cartridge base (or the control body) may include one or more pins, and the control body (or cartridge base) may include one or more corresponding L-shaped slots.

Figure 9A:
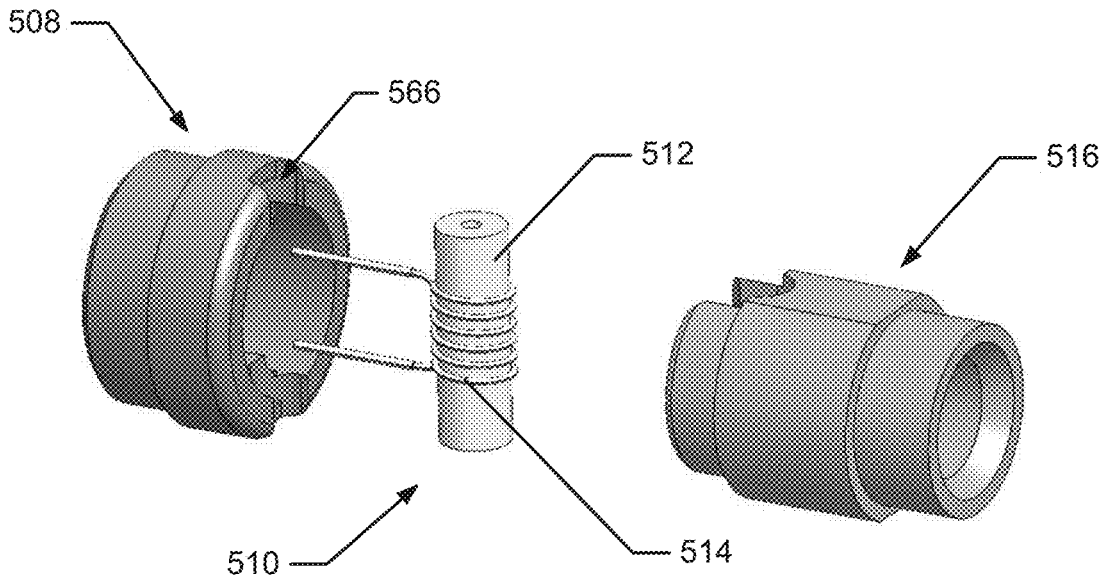
FIG. 9A illustrates an exploded perspective view of a lower atomizer seal, an atomizer, and an upper atomizer seal, according to an example implementation of the present disclosure.
Figure 9B:
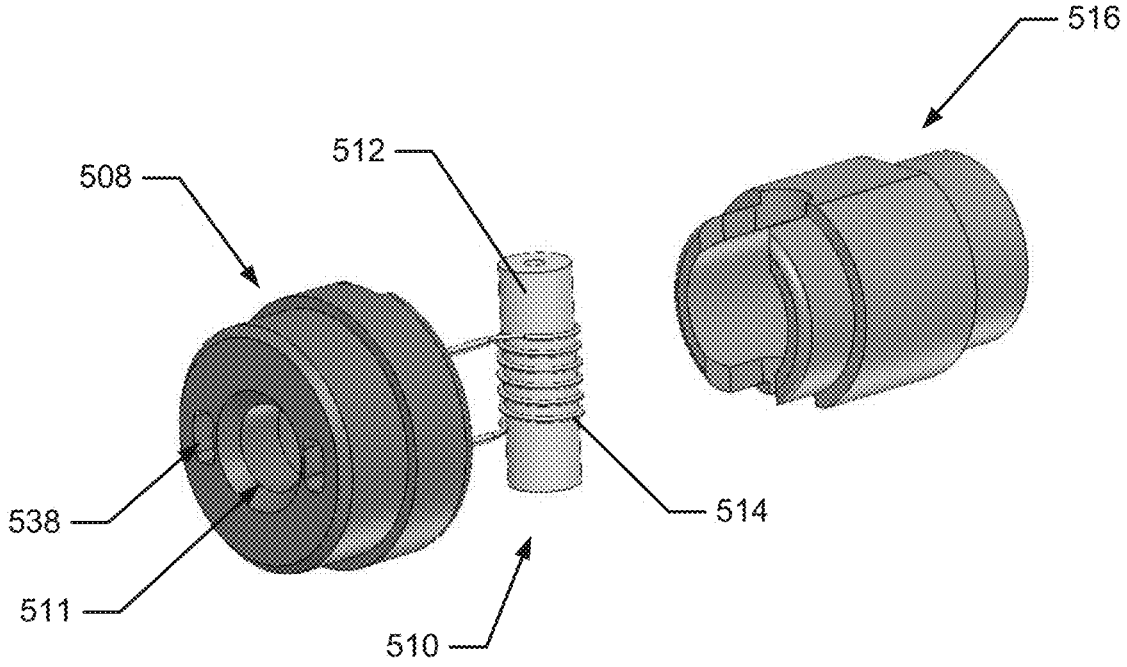
FIG. 9B illustrates an exploded rear perspective view of the lower atomizer seal, atomizer, and upper atomizer seal of FIG. 9A, according to an example implementation of the present disclosure.

In the depicted implementation, the lower atomizer seal 508 engages with the connector 504 at an upper end thereof and is also configured to receive an upper end of the center pin 502 through a central channel 511 (see FIG. 9B). In various implementations, the center pin 502 is constructed of a conductive material, which may be the same material or a different material as the connector 504. For example, in various implementations, the center pin 502 may be constructed of a metal material. As will be discussed in more detail below, the connector 504 and the center pin 502 serve as electrical connectors for the atomizer 510, and thus the insulating ring 506 and the lower atomizer seal 508 are configured to isolate (at least electrically) the connector 504 and the center pin 502 from each other. In such a manner, the insulating ring 506 sealingly engages an internal annular flange 536 of the connector 504, and the lower atomizer seal 508 sealingly engages an inner surface of the connector 504 as well as an inner surface of the cartridge base 520. As such, the insulating ring 506 and the lower atomizer seal 508 are constructed of an insulating material, such as, for example, a rubber or plastic material. In the depicted implementation, the insulating ring 506 and the lower atomizer seal 508 may comprise silicone, thermoplastic polyurethane, or another resilient material. In the depicted implementation, the center pin 502 is constructed of brass C3604 and is plated with a copper-nickel (CuNi) plating, the insulting ring 506 and upper atomizer seal 516 are constructed of silicone, shore hardness 60A, and the lower atomizer seal 508 is constructed of silicone, shore hardness 65A. It should be noted, however, that in other implementations, various other materials are possible for any of the components of the cartridge 500.

As further illustrated in FIGS. 6 and 7, the lower atomizer seal 508 is also configured to locate the atomizer 510, which in the depicted implementation, comprises a liquid transport element 512 and a heating element 514, which, in some implementations, may comprise a wire. In various implementations, the liquid transport element 512 may comprise a porous monolith. For example, in the depicted implementation, the liquid transport element 512 may comprise a ceramic material such that aerosol precursor composition delivered to the liquid transport element 512 may be absorbed therein for aerosolization. In various implementations, the heating element 514 may be wrapped or coiled around the liquid transport element 512, as shown. In some implementations, the wire of the heating element 514 may comprise titanium, Kanthal (FeCrAl), Nichrome, Molybdenum disilicide ($MoSi_2$), molybdenum silicide (MoSi), Molybdenum disilicide doped with Aluminum ($Mo(Si,Al)_2$), graphite and graphite-based materials; ceramic (e.g., a positive or negative temperature coefficient ceramic), Tungsten, and Tungsten-based alloys, or any other suitable materials, such as those noted elsewhere herein. Tungsten and Tungsten-based alloys may be useful in that these materials may define a coefficient of expansion suitable for usage with many ceramics, which may be employed in the liquid transport element 512. To create the heating circuit, in various implementations, one end of the heating element 514 contacts the conductive center pin 502, which, when connected to the control body, receives a positive connection to the power unit, and the other end of the heating element 514 contacts the conductive connector 504, which receives a negative connection to the power unit.

As noted, according to some implementations, the atomizer 510 may be formed by winding a wire about a liquid transport element as described in U.S. Pat. No. 9,210,738 to Ward et al., which is incorporated herein by reference in its entirety. However, various other methods may be employed to form the atomizer 510, and various other implementations of a heating element may be employed in the atomizer. For example, a heating element may be configured to heat the aerosol precursor composition disposed within a liquid transport element via radiant heating, as described in U.S. Pat. App. Pub. No. 2017/0020193, filed Dec. 3, 2015, the content of which is incorporated herein by reference in its entirety. In another implementation, the heating element 316 may be configured to heat the aerosol precursor composition via inductive heating, as described in U.S. Pat. App. Pub. No. 2017/0127722, filed Nov. 6, 2015, the content of which is incorporated herein by reference in its entirety.

Although not depicted in this manner, in some implementations, the wire of the heating element 514 may be at least partially imbedded in the liquid transport element 512. In this regard, in the case of a ceramic liquid transport element 512, the wire of the heating element 514 may be imbedded in the liquid transport element 512 before the liquid transport element 512 is fired in a high temperature oven known as a kiln. For example, the wire may be wrapped about a long section of the base material from which the ceramic is formed prior to firing the material. Examples of such base materials employed to form the ceramic in the liquid transport element 512 may include clay, oxides, nonoxides, and composites. Thereby, the wire may at least partially imbed in the base material during wrapping thereabout. The base material and the wire may then be fired in the kiln. Afterwards, a saw or other cutting device may divide the product into individual atomizers having a desired length.

In the depicted implementation, the atomizer 510 is also located by an upper atomizer seal 516, which is also configured to sealingly engage an inside surface of an upper portion of the cartridge base 520. As with the insulating ring 506 and the lower atomizer seal 508, in various implementations, the upper atomizer seal 516 is constructed of an insulating material, such as, for example, a rubber or plastic material. In the depicted implementation, the upper atomizer seal 516 is constructed of silicone. An atomizer chamber 540 is formed around the atomizer 510 and is bounded by an inner chamber 542 of the lower atomizer seal 508 (and a top portion of the center pin 502) and an inner chamber 544 of the upper atomizer seal 516 (see FIG. 7). When assembled, the atomizer 510 (i.e., the liquid transport element 512 and the heating element 514) traverses across the atomizer chamber 540. An end of the upper atomizer seal 516 opposite the atomizer chamber 540 is configured to receive the aerosol tube 528, the opposite end of which is configured to extend inside a portion of an aerosol channel 546 of the reservoir tank 530. The aerosol channel 546 of the reservoir tank 530 extends through the reservoir tank 530 and terminates at an opening 548 (see FIG. 11) at a mouth end 550 of the reservoir tank 530. In the depicted implementation, an internal annular flange 549 of the upper atomizer seal 516 locates one end of the aerosol tube 528. Although in various implementations, the aerosol tube 528 may be made of a variety of materials, including various plastic or metal materials, in the depicted implementation, the aerosol tube is constructed of 304 stainless steel.

Figure 8:
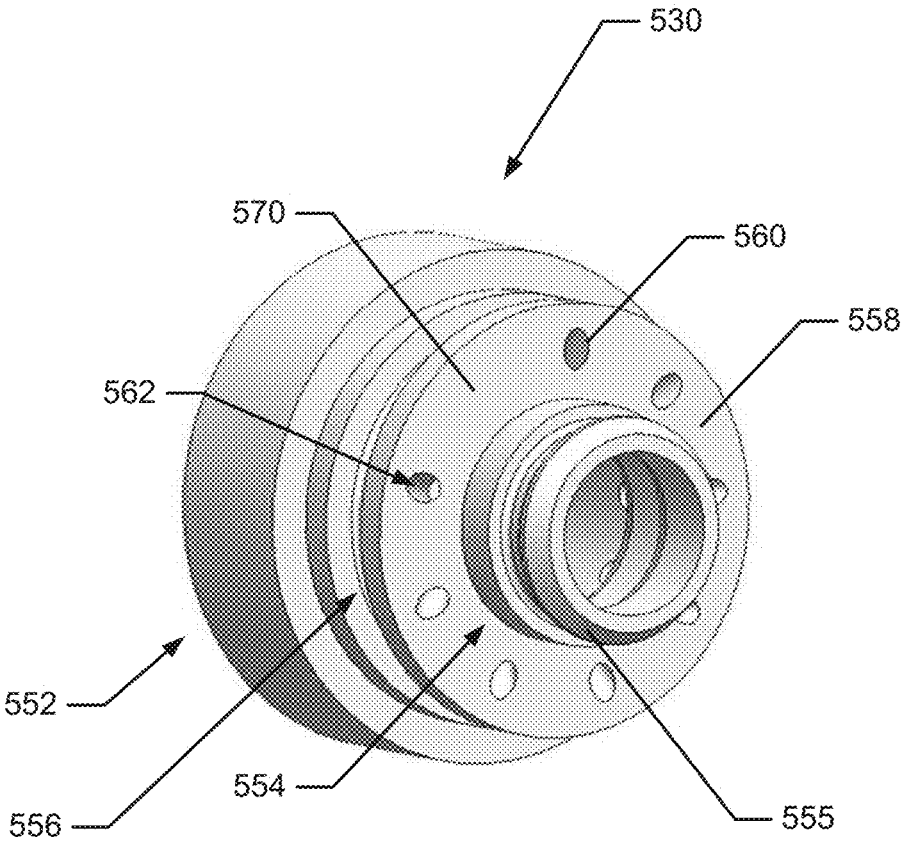
FIG. 8 illustrates a perspective view of a cartridge base, according to an example implementation of the present disclosure.

FIG. 8 illustrates a perspective view of the cartridge base 530, according to an example implementation of the present disclosure. As shown in the drawings, the cartridge base 530 generally includes a lower body portion 552 and an upper extension 554. The upper extension 554 includes a locating flange 555, which includes chamfered leading and trailing edges (see FIGS. 6 and 7) that are received by a locating feature of the reservoir tank 530. The lower body portion 552 is configured to be proximate the control body 200 when assembled, and includes a seal groove 556 configured to receive the lower base seal 518, and a coupling surface 558, to which the flavor disc 522 is attached. As shown in the figure and as described in more detail below, the coupling surface 558 includes a series of openings 560, each of which creates a separate flavor duct 562 leading to a liquid chamber 564 (see FIGS. 6 and 7) that extends peripherally above the lower atomizer seal 508 and around the liquid transport element 512. A pair of transport grooves 566 (see FIG. 9A) located in the lower atomizer seal 508 that are proximate the ends of the liquid transport element 512 allow liquid from the liquid chamber 564 to enter a central chamber 568 of the liquid transport element 512. As will be discussed in more detail below, in various implementations the number of cartridge base openings 560 (and thus flavor ducts 562) may correspond with the number of flavors available in the flavor disc 522. In such a manner, each flavor duct 562 may be configured to impart a respective flavor to an initial aerosol precursor composition 602 from the reservoir tank 530. In some implementations, the coupling surface 558 of the cartridge base 530 may include a solid portion 570 wherein the respective area is devoid of a flavor opening (and thus devoid of a flavor duct). As such, the solid portion 570 of the coupling surface may correspond with a solid section 575 of the flavor disc 522, as will be discussed in more detail below. In the depicted implementation the flavor disc 522 is constructed of the same material as the cartridge base 520, in particular, Tritan™, although in other implementations, other materials are possible, and the cartridge base 520 and the flavor disc 522 need not be constructed of the same material.

Figure 10:
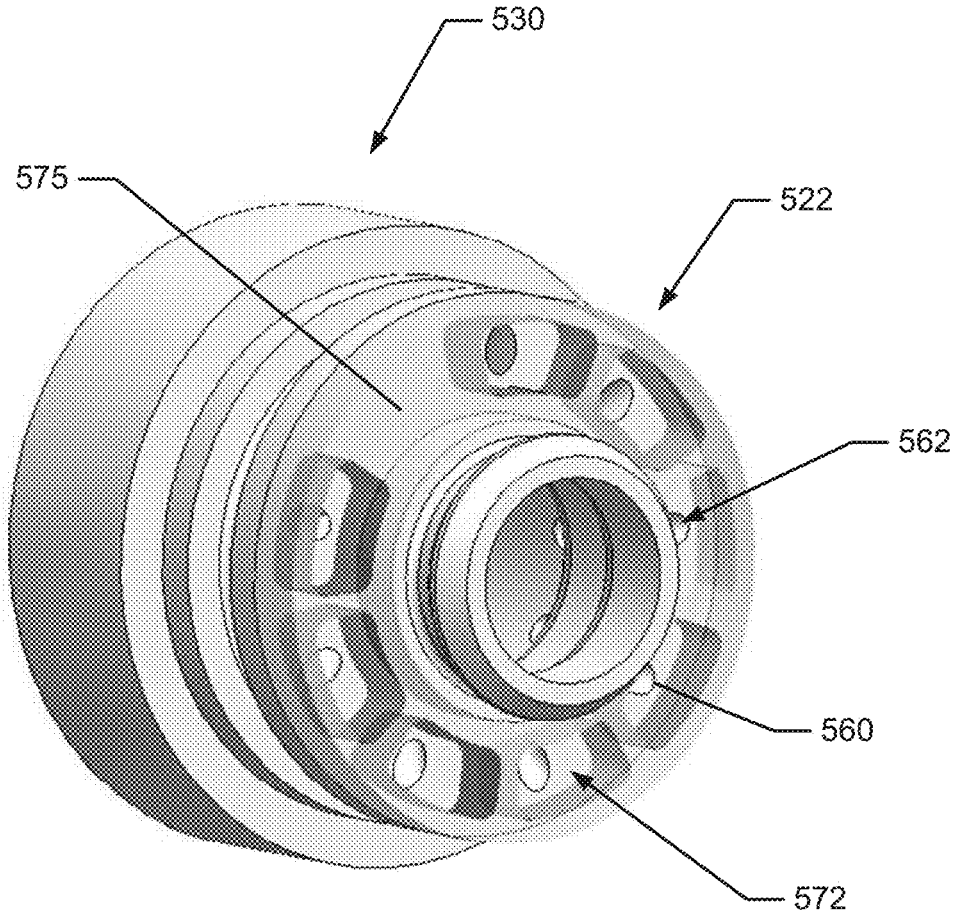
FIG. 10 illustrates a perspective view of a cartridge base and flavor disc, according to an example implementation of the present disclosure.

FIG. 10 illustrates a perspective view of the flavor disc 522 fixedly coupled to the cartridge base 520. In various implementations, the flavor disc 522 may be fixedly coupled to the cartridge base in a variety of ways. For example, in some implementation this attachment may be via a mechanical interface, such as, for example, where an inner diameter of the masking disc is smaller than an outer diameter of a mating surface of the cartridge base 520 (e.g, to create a transition fit or interference fit). In other implementations, this attachment may be via use of one or more adhesives. In still other implementations, the masking disc may be part of the cartridge base such that the flavor disc and reservoir tank comprise a unitary part. In any event, the flavor disc 522 may include two or more separate sections that are configured to permit the initial aerosol precursor composition to pass therethrough, and at least one of the sections may comprise a flavor section 572 that contains a flavorant.

In various implementations, the initial aerosol precursor composition 602 may comprise an unflavored aerosol precursor composition or a flavored aerosol precursor composition (i.e., an aerosol precursor composition that includes one or more flavorants). As used herein, reference to a "flavorant" refers to compounds or components that can be aerosolized and delivered to a user and which impart a sensory experience in terms of taste and/or aroma. Exemplary flavorants include, but are not limited to, vanillin, ethyl vanillin, cream, tea, coffee, fruit (e.g., apple, cherry, strawberry, peach and citrus flavors, including lime and lemon), maple, menthol, mint, peppermint, spearmint, wintergreen, nutmeg, clove, lavender, cardamom, ginger, honey, anise, sage, rosemary, hibiscus, rose hip, yerba mate, guayusa, honeybush, rooibos, yerba santa, bacopa monniera, gingko biloba, withania somnifera, cinnamon, sandalwood, jasmine, cascarilla, cocoa, licorice, and flavorings and flavor packages of the type and character traditionally used for the flavoring of cigarette, cigar, and pipe tobaccos. Syrups, such as high fructose corn syrup, also can be employed. Exemplary plant-derived compositions that may be suitable are disclosed in U.S. Pat. No. 9,107,453 and U.S. Pat. App. Pub. No. 2012/0152265 both to Dube et al., the disclosures of which are incorporated herein by reference in their entireties. The selection of such further components are variable based upon factors such as the sensory characteristics that are desired for the smoking article, and the present disclosure is intended to encompass any such further components that are readily apparent to those skilled in the art of tobacco and tobacco-related or tobacco-derived products. See, e.g., Gutcho, Tobacco Flavoring Substances and Methods, Noyes Data Corp. (1972) and Leffingwell et al., Tobacco Flavoring for Smoking Products (1972), the disclosures of which are incorporated herein by reference in their entireties. It should be noted that reference to a flavorant should not be limited to any single flavorant as described above, and may, in fact, represent a combination of one or more flavorants.

The flavor disc 522 of the depicted implementation includes nine total sections, with eight of the sections representing separate flavor sections 572. Although the flavor disc 522 may be constructed of one or more various materials, for clarity of illustration, the flavor disc 522 is shown in the drawings as being transparent and the flavor sections 572 are represented by different colors, each of which contains a separate flavorant. It should be noted, however, that in other implementations, there may be any number of sections, wherein any of the sections may be a flavor section. In addition, in some implementations, there may be one or more bypass sections wherein the section does not include a flavorant such that no flavor is mixed with the aerosol precursor composition. As such, in some implementations, there may only be two separate sections, with one section comprising a flavor section and the other section comprising a bypass section. In addition, in some implementations one or more of the flavor sections may include the same flavorant or a different flavorant than one or more other sections of the flavor disc. The flavor disc of the depicted implementation also includes an additional section that represents a solid section 575 corresponding to the solid portion 570 of the coupling surface 558 of the cartridge base 530. It should be noted that in various implementations, the cartridge may include more than one solid section, and, in some implementations, the cartridge may not include a solid section.

Figure 13:
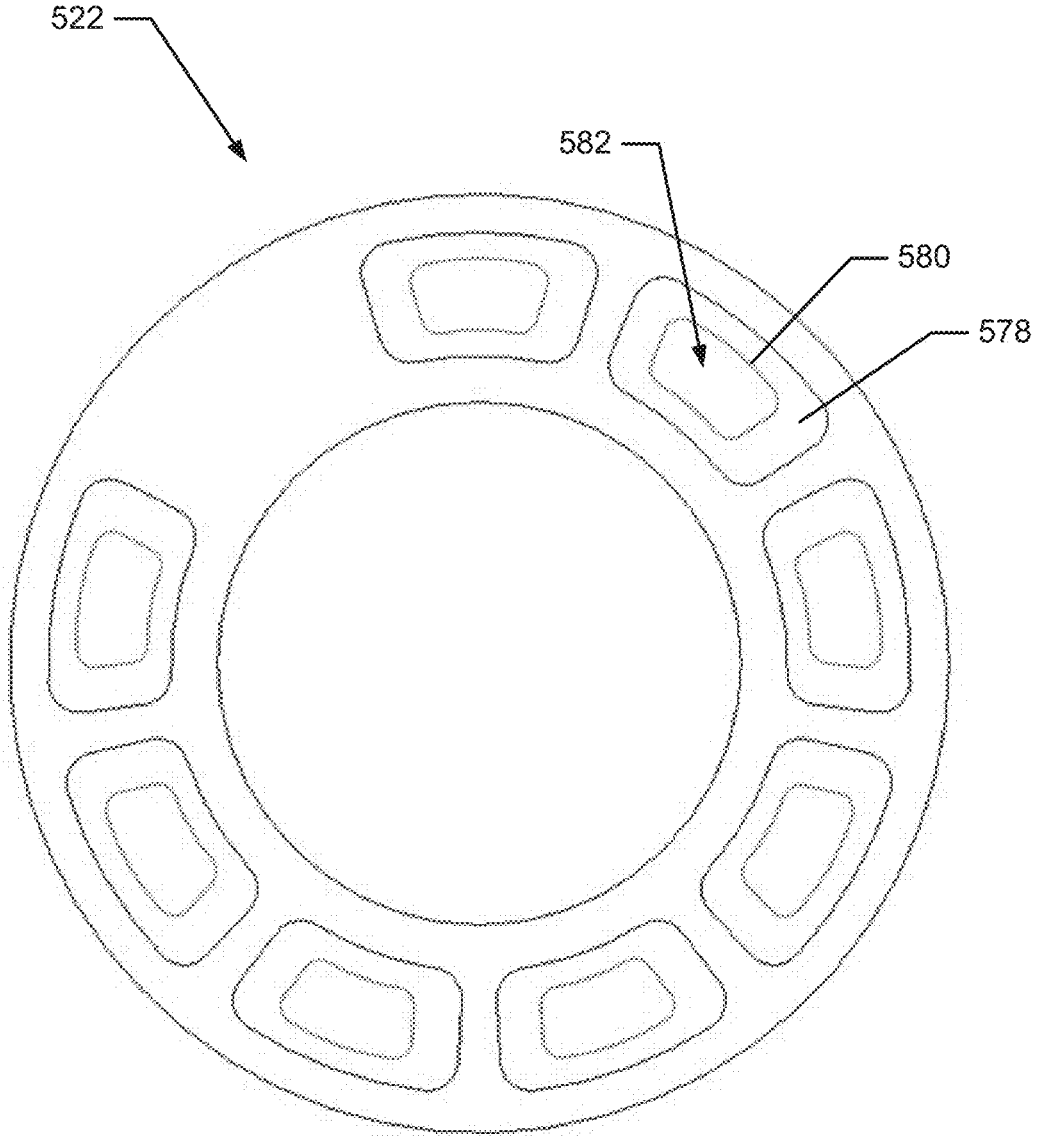
FIG. 13 illustrates a front view of a flavor disc, according to another example implementation of the present disclosure.

In some implementations, a flavor section 572 may comprise a section of the flavor disc 522 that includes a flavorant in a liquid form. In other implementations, a flavor section 572 may comprise a substrate or other material in which the flavorant is absorbed or otherwise contained. For example, in some implementations, a flavor section 572 may comprise carbon materials, ceramics, polymers, composites, metals, cellulosics, and the like. In certain implementations, the material may either be porous (e.g., a porous carbon material) or in the form of a gel or coating that allows transport of the flavorant to the initial aerosol precursor composition for volatilization. An example of a flavor disc 522 according to another implementation of the present disclosure is illustrated in FIG. 13. In the depicted implementation, the flavor disc 522 includes a plurality of flavor sections 572, each of which comprises an outer shell 578 defining an inner surface 580 that surrounds an inner chamber 582. In the depicted implementation, the outer shell 578 comprises a porous material that contains a flavorant, and the inner chamber 582 is configured to allow the aerosol precursor composition to flow therethrough and against the inner surface 580, thus imparting the initial aerosol precursor composition with the flavorant, such as, for example, by mixing the flavorant with the initial aerosol precursor composition. In the depicted implementation, there are eight separate flavor sections 572, each of which contains a separate flavorant, however, as noted above there may be any number of sections, wherein one or more of the sections may include the same or different flavorants, and one or more of sections may be bypass sections.

Figure 11:
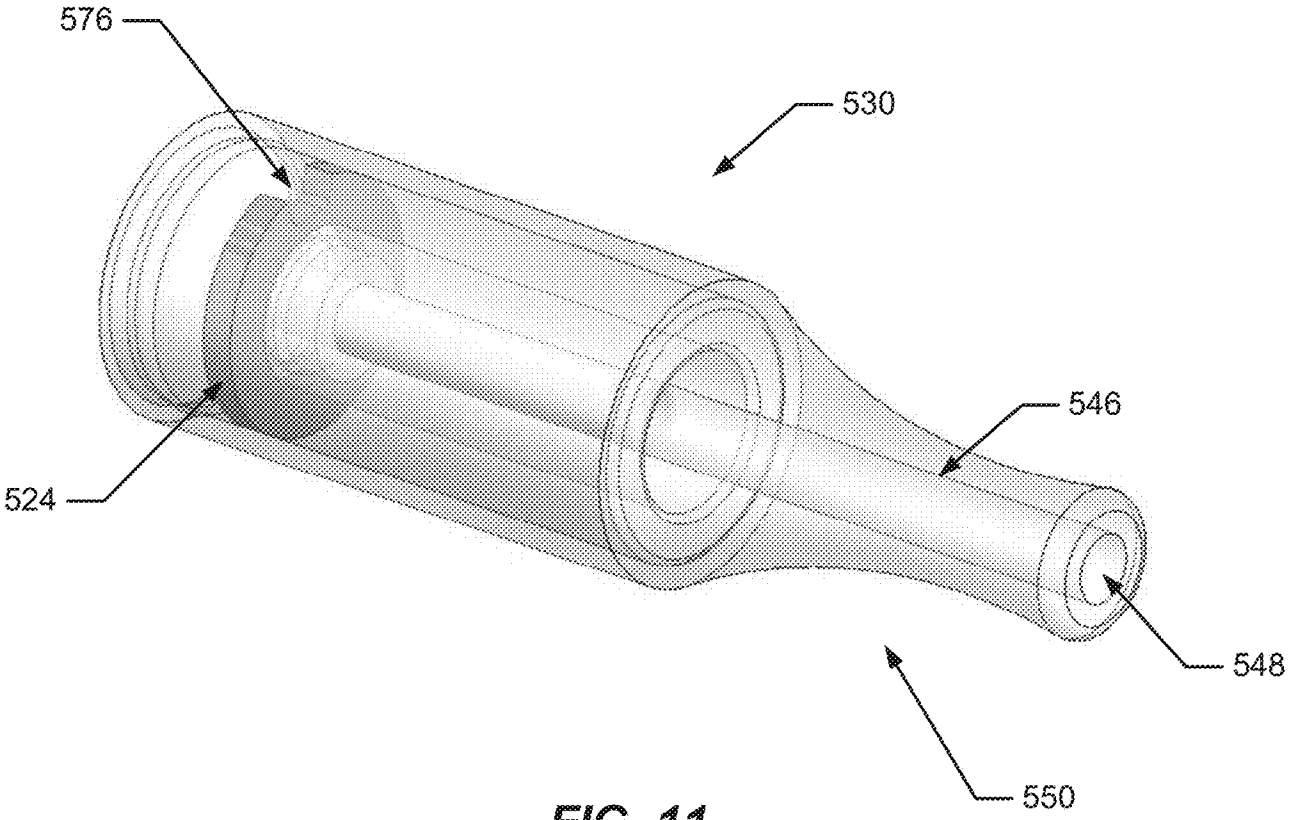
FIG. 11 illustrates a perspective view of a reservoir tank and masking disc, according to an example implementation of the present disclosure.
Figure 12:
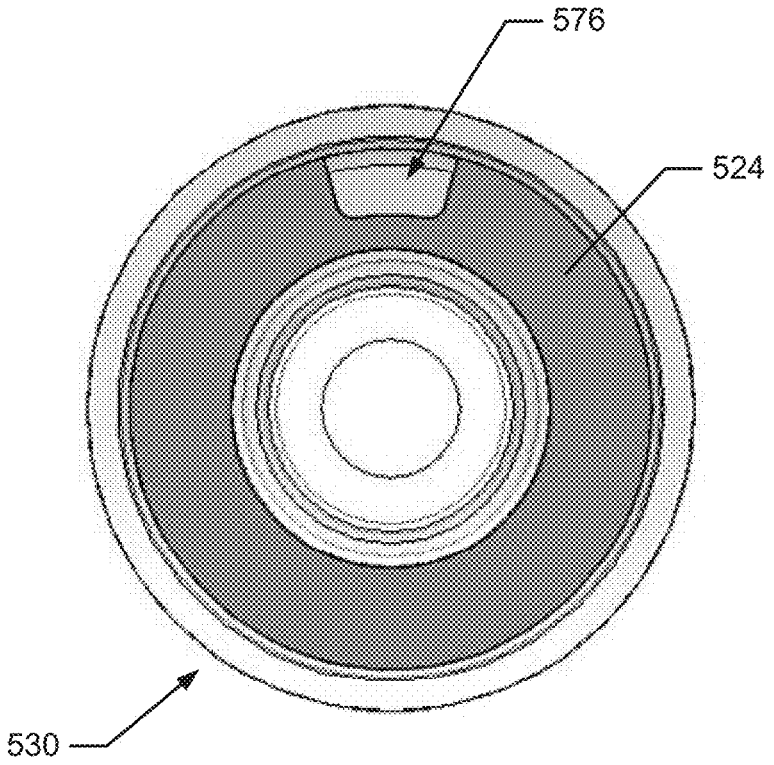
FIG. 12 illustrates a back view of a reservoir tank and masking disc, according to an example implementation of the present disclosure.

FIG. 11 illustrates a perspective view of a reservoir tank 530 and masking disc 524, and FIG. 12 illustrates a back view of the reservoir tank 530 and masking disk 524, according to an example implementation of the present disclosure. In various implementations, the reservoir tank 530 may be constructed of one or more of a variety of materials, including, for example, a metal material, a glass material, and/or a plastic material, such as, for example, an acrylic material (e.g., polymethlamethacrylate). In some implementations, the reservoir tank 530 may comprise a translucent or transparent material, such that a user may view the quantity of the aerosol precursor composition remaining therein. In the depicted implementation, the reservoir tank 530 is constructed of polypropelene or Tritan™, although in other implementations, other materials are possible In various implementations, the masking disc 524 may be configured to be fixedly attached to the lower portion of the reservoir tank 530. In one example implementation, this attachment may be via a mechanical interface, such as, for example, where an outer diameter of the masking disc is larger than an inner diameter of the mating surface of the reservoir tank 530 (e.g, to create a transition fit or interference fit). In another example implementation, the masking disc 524 may be ultrasonically welded to the reservoir tank 530. In other implementations, this attachment may be via use of one or more adhesives. In still other implementations, the masking disc 524 may be part of the reservoir tank 530 such that the masking disc 534 and reservoir tank 530 comprise a unitary part. In any event, the masking disc 524 is configured to substantially seal the liquid cavity 574, except for an opening 576 formed in the masking disc 524. As may be understood, various other mechanisms and techniques may be employed to retain the masking disc 524 in engagement with the reservoir tank 530. However, ultrasonic welding may be useful in that it may provide a hermetic seal without requiring an additional component or substance to form the seal.

As will be discussed in more detail below, the opening 576 in the masking disc 524 is configured to allow the initial aerosol precursor composition 602 to flow therethrough. In various implementations, the masking disc 524 may be constructed of a similar material as the reservoir tank 530. In the depicted implementation, the masking disc 524 is constructed of Tritan™, although in other implementations, other materials are possible, such as, for example, polypropylene or a stamped metal, such as stainless steel or aluminum.

Referring back to FIGS. 6 and 7, the reservoir tank 530 may comprise a housing that includes an aerosol channel 546 that extends from one end proximate the upper extension 554 of the cartridge base 520 (when assembled) and terminates at the opening 548 at the mouth end 550 of the reservoir tank 530. The housing also includes a locating groove 557, which is configured (when assembled) to engage the locating flange 555 of the cartridge base 520. The housing also defines a substantially cylindrical liquid cavity 574 that extends around, but does not intersect, the aerosol channel 546. In such a manner, as will be discussed in more detail below, the liquid cavity 574 is configured to contain the initial aerosol precursor composition 602, and the aerosol channel 546 is configured to carry the resulting aerosol 606 through the opening 548 in the mouth end 550 of the reservoir tank 530. In various implementations, the aerosol channel 546 may be formed of an outer wall of the housing that is substantially shaped as a cylindrical tube and is disposed interior to the liquid chamber 574 of the reservoir tank 530.

As shown in the drawings, the lower base seal 518 forms a seal between the cartridge base 520 and the reservoir tank 530, and the upper base seal 526 forms a seal between the reservoir tank 530 and the aerosol tube 528. In the depicted implementation, the lower base seal 518 and the upper base seal 526 comprise O-rings constructed of a synthetic rubber or thermoplastic material, although other materials and constructions are possible. When assembled together, the center pin 502, connector 504, insulating ring 506, lower atomizer seal 508, atomizer 510, upper atomizer seal 516, lower cartridge base seal 518, flavor disc 522, upper cartridge base seal 526, and aerosol tube 528 form a cartridge base assembly. Likewise, when assembled together, the reservoir tank 530 and masking disc 522 form a reservoir assembly. In the depicted implementation, the reservoir assembly is configured to be coupled to cartridge assembly by sliding the reservoir assembly onto the cartridge base assembly such that the locating flange 555 of the cartridge base 520 is received by and/or engages with the locating groove 557 of the reservoir tank 530. In such a manner, after the reservoir assembly has been coupled to the cartridge base assembly, the reservoir assembly is configured to rotate relative to the cartridge base assembly.

In operation (referring to FIGS. 6 and 7), the cartridge 500 is removably attached to the control body 200 via the external threads 534 of the connector 504 by tightening the threaded connector 504 against the control body 200. Because in the depicted implementation the connector 504 and the cartridge base 520 are fixedly attached to each other as described above, when the cartridge 500 is attached to the control body 200 and tightened, the cartridge base 520 and the control body 200 do not easily move relative to each other. The center pin 502, insulating ring 506, lower atomizer seal 508, atomizer 510, upper atomizer seal 516, flavor disc 522, and aerosol tube 528 also do not typically move relative to the cartridge base 520, and thus when assembled, the reservoir tank 530 and masking disc 524 are configured to rotate relative to these components. As a result, the masking disc 524 may be rotated relative to the flavor disc 522 via rotation of the reservoir tank 530. Thus, a consumer may selectively align the opening 576 of the masking disc 524 with a selected flavor section 572 by rotating the reservoir tank 530 to the appropriate location. In various implementations, the cartridge 500 and/or control body may include one or more indicators to aid the consumer in determining a rotation location. For example, in some implementations the cartridge 500 and/or the control body may include visual indicators, such as a plurality of markings, thereon so as to indicate the locations of the various flavor sections of the flavor disc 522. Alternatively, or in addition, the cartridge 500 and/or control body may include one or more audible or tangible indicators, such as, for example, a series of detents (which, in some implementations, may also include a sound) that indicate the location of the various flavor sections. It should be noted that in some implementations, one or more of any of the components described above may be able to move relative to the others without affecting the operation of the device.

Because the liquid cavity 574 of the reservoir tank 530 is sealed by the masking disc 524 except for the opening 576, when the opening 576 of the masking disc 522 is aligned with a selected flavor section 572 of the flavor disc 522, the initial aerosol precursor composition 602 contained in the liquid cavity 574 will pass through the selected flavor section 572 before entering the atomizer chamber 540. As a result, the initial aerosol precursor composition 602 will mix with the flavorant in the selected flavor section 572 such that the flavorant is imparted to the initial aerosol precursor composition 602 and the resultant aerosol precursor composition comprises a flavored aerosol precursor composition 604 (i.e., an initial aerosol precursor composition mixed with the flavorant). The flavored aerosol precursor composition 604 then flows through the corresponding flavor duct 562 of the cartridge base 520 and into the liquid chamber 564 that extends peripherally above the lower atomizer seal 508 and around the liquid transport element 512. The transport grooves 566 located in the lower atomizer seal 508 allow the flavored aerosol precursor composition 604 to contact the liquid transport element 512 and/or enter the central chamber 568 thereof such that the wetted liquid transport element 512 may be aerosolized by the heater coil 514. FIG. 6 illustrates flow of the initial aerosol precursor composition 602 through the opening 576 in the masking disc 524, through the selected flavor section 572 of the flavor disc 522, into the liquid chamber 564, onto the liquid transport element 512, and into the central chamber 568 thereof. It should be noted that in various implementations, the channels and pathways described above may be configured such that the flow of the initial aerosol precursor composition 602 and the flavored aerosol precursor composition 604 may occur via capillary action. In such a manner, the flow of the initial aerosol precursor composition 602 and the flavored aerosol precursor composition 604 may occur in any orientation of the cartridge 500. Further, an entrained volume of the initial aerosol precursor composition 602 and the flavored aerosol precursor composition 604 in the various downstream components may allow for continued operation in any orientation.

In some implementations, for example, unidirectional flow of the aerosol precursor composition may be accomplishing using differences in the porosity of the components through which the aerosol precursor composition flows. For example, in some implementations, the material of the flavor section 572 through which the initial aerosol precursor composition 602 flows, may have one porosity, the material of flavor ducts 562 through which the flavored aerosol precursor composition 604 flows may have a smaller porosity, and the material of the liquid transport element 512 into which the flavored aerosol precursor composition flows may have an even smaller porosity, such that the liquid is drawn in one direction from the liquid cavity 574 to the liquid transport element 512. It should be noted that in other implementations unidirectional flow may be accomplished via other means. For example, in some implementations, the materials through which the aerosol precursor compositions flow may have progressively decreasing contact angles such that the liquid is drawn in one direction from the liquid cavity 574 to the liquid transport element 512.

According to some aspects, the various liquid orifices and channels described above may be configured such that the flow of the initial aerosol precursor composition 602 and the flavored aerosol precursor composition 604 may provide for the precise transfer of a desired amount of aerosol precursor composition from the liquid cavity 574 to the atomizer chamber 540. For example, the various aerosol precursor composition orifices and channels may be shaped and/or configured so as to provide for the transfer of small volumes of liquid (i.e., the initial aerosol precursor composition and/or the flavored aerosol precursor composition), such as milliliter or smaller, microliter or smaller, from the liquid chamber 574 to the atomizer chamber 540. Additionally and/or alternatively, one or more of the aerosol precursor composition orifices and channels may be shaped and/or configured so as to substantially limit and/or prevent any amount of aerosol precursor composition retained within the liquid cavity 574 from vaporizing prematurely (i.e., vaporizing before being provided to the atomizer chamber 540). For example, the various aerosol precursor composition orifices and channels may be shaped and/or configured such that a pressure within the liquid cavity 574 does not decrease past an operational threshold during use of the aerosol delivery device. Additionally, the various aerosol precursor composition orifices and channels may be sized in response to the surface energy of the aerosol precursor composition retained within the liquid cavity 574. Such sizing can be particularly adapted to substantially resist bulk liquid flow from the liquid cavity 574 until a negative pressure is applied (i.e., via a draw on the mouth end 550 of the cartridge 500), at which time the desired volume of liquid may be expressed through the aerosol precursor composition orifice 516. Accordingly, in some implementations, the aerosol precursor composition orifice(s) and channels may have a size in the range of about 0.02 mm to about 0.11 mm, about 0.03 mm to about 0.1 mm, or about 0.04 mm to about 0.09 mm. When a plurality of aerosol precursor composition orifices and channels are present, in some implementations, each orifice or channel may have substantially the same size, or two or more orifices or channels may have different sizes.

An electrical connection between the control body 200 and the atomizer 510 via the two ends of the heating element 514 allows the control body 200 to direct electrical current to the atomizer 510, such as upon actuation by the user (e.g., via a button) and/or when a puff on the aerosol delivery device is detected. In this regard, the longitudinal end of the cartridge 500 opposite the cartridge base 520 defines the mouth end 550 of the reservoir tank 530. When a user draws on the mouth end 550 of the cartridge 500, air 600 (see FIG. 7) may be directed through one or more air intakes in the connector 504 from the environment between the connector 504 and the control body. The air 600 drawn through the air intake(s) may then be drawn around the center pin 502, along a slot in the bottom thereof, and through the center of the center pin 502, such that the air 600 exits through one or more peripheral openings into an annular area of the connector 504. From there, the air 600 is drawn through one or more openings 538 (see FIG. 9B) in the bottom of the lower atomizer seal 508 and into the atomizer chamber 540.

As the air is drawn through the air intake(s) of the connector 504, a flow sensor (see e.g., FIG. 2) may detect the draw. Thereby, the control body 200 may direct current through the heating element 514 to heat the atomizer 510. As the atomizer 510 heats, the flavored aerosol precursor composition 604 may be vaporized at the atomizer 510 directly or via heating of the liquid transport element 512. Accordingly, the resultant vapor or aerosol 606 may be produced at the atomizer chamber 540 and then directed to the user. In particular, as the air 600 enters the atomizer chamber 540, it travels past the liquid transport element 512 inside the upper atomizer seal 516. At such point, the air 600 mixes with the vaporized flavored aerosol precursor composition 604 and becomes the aerosol 606. The aerosol 606 may then travel through upper atomizer seal 516, into the aerosol tube 528, and out of the mouth end 550 of the cartridge 500 to the user through the aerosol channel 546.

Figure 14:
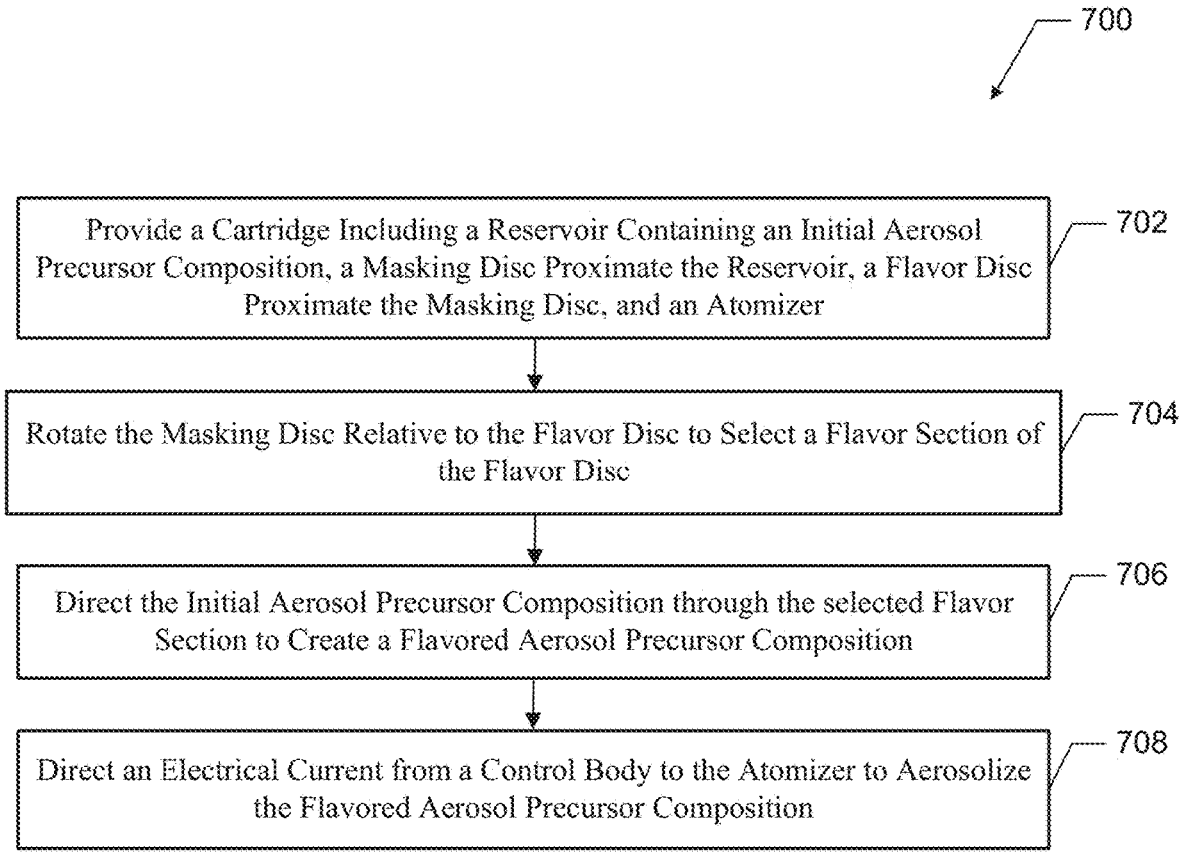
FIG. 14 schematically illustrates an aerosol delivery device operation method, according to an example implementation of the present disclosure.

FIG. 14 schematically illustrates an aerosol delivery device operation method, according to an example implementation of the present disclosure. As similarly described above, the aerosol delivery device may comprise a cartridge and a control body. As illustrated in FIG. 14, the method 700 may comprise providing a cartridge that includes a reservoir containing an initial aerosol precursor composition, a masking disc proximate the reservoir, a flavor disc proximate the masking disc, and an atomizer at operation 702. In various implementations the reservoir, masking disc, flavor disc, initial aerosol precursor composition, and atomizer may be configured as described above with respect to FIGS. 4-13. The method 700 may further comprise rotating the masking disc relative to the flavor disc to select a flavor section of the flavor disc at operation 704. In some implementations, this may comprise aligning an opening in the masking disc with a selected flavor section of the flavor disc. At operation 706, the method 700 may further comprise directing the initial aerosol precursor composition through the selected flavor section of the flavor disc to create a flavored aerosol precursor composition. In various implementations, this may comprise allowing the initial aerosol precursor composition to flow through a flavor section of the flavor disc and into an atomizer chamber (for example, via capillary action) such that the initial aerosol precursor composition is imparted with the flavorant from the selected flavor section of the flavor disc. The method 700 may further comprise directing an electrical current from a control body to the atomizer to aerosolize the flavored aerosol precursor composition at operation 708. In various implementations, this may comprise heating a heater coil that heats a liquid transport element that contains the flavored aerosol precursor composition so as to vaporize the flavored aerosol precursor composition.

The foregoing description of use of the device can be applied to the various implementations described herein through minor modifications, which can be apparent to the person of skill in the art in light of the further disclosure provided herein. The above description of use, however, is not intended to limit the use of the article but is provided to comply with all necessary requirements of disclosure of the present disclosure.

In various implementations, the device and method of the present disclosure may be provided in a variety of other alternate forms. For example, in some implementations, both the masking disc and the flavor disc may be configured to be rotated independently. In such a manner, a user may control the relative amount of flavorant added to the initial aerosol precursor composition from a selected flavor section. In other implementations, the flavor disc may rotate and there may be a common liquid path leading to the atomizer chamber. In such a manner, a user may rotate the flavor disc to select a flavor section so as to direct the initial aerosol precursor composition through the selected flavor section to create the flavored aerosol precursor composition, which then flows through the common path to the atomizer chamber. In other implementations, the liquid tank and the flavor disc may have separate paths leading to the atomizer chamber. In such a manner, the separate paths may converge before the atomizer chamber or may separately lead to the atomizer chamber. In still other implementations, the selection of a flavor section and/or the flow of the initial aerosol precursor composition and/or the flow of the flavored aerosol precursor composition may be controlled via one or more electronically controlled valves. In still other implementations, the flavor section may comprise two parallel channels wherein one channel allows the initial aerosol precursor composition to flow therethrough to the aerosol chamber without being mixed with the flavorant, and the other channel delivers the flavorant directly to aerosol chamber. In such a manner, the initial precursor composition may be mixed with the flavorant in the aerosol chamber.

Many modifications and other implementations of the disclosure will come to mind to one skilled in the art to which this disclosure pertains having the benefit of the teachings presented in the foregoing descriptions and the associated drawings. Therefore, it is to be understood that the disclosure is not to be limited to the specific embodiments disclosed herein and that modifications and other embodiments are intended to be included within the scope of the appended claims. Although specific terms are employed herein, they are used in a generic and descriptive sense only and not for purposes of limitation.

The invention claimed is:

1. An aerosol delivery device, comprising:

a control body;

a cartridge, comprising:

a reservoir tank configured to contain an aerosol precursor composition;

an opening configured to the permit aerosol precursor composition to pass therethrough; and two or more separate sections, wherein at least two of the sections are configured to permit the aerosol precursor composition to pass therethrough, and at least one of the sections comprises a flavor section that contains a flavorant; and an atomizer configured to receive the aerosol precursor composition and produce an aerosol, wherein a selected section of the two or more sections is configured to align with the opening so as to allow the aerosol precursor composition to flow from the reservoir tank through the opening and the selected section such that, when the flavor section is selected, the flavorant is imparted to the aerosol precursor composition delivered to the atomizer.

2. The aerosol delivery device of claim 1, wherein one of the two or more sections comprises a solid section configured to block the flow of the aerosol precursor composition when the opening is aligned therewith.

3. The aerosol delivery device of claim 1, further comprising a cartridge base that includes two or more passageways, wherein each passageway is configured to align with a separate section so as to facilitate flow of the aerosol precursor composition from the reservoir tank through the selected section and to the atomizer.

4. The aerosol delivery device of claim 1, wherein the reservoir tank is configured to be rotated so as to align the opening with a selected section.

5. The aerosol delivery device of claim 1, wherein the reservoir tank comprises a housing that includes a liquid cavity defined therein, and wherein the liquid cavity is configured to contain the aerosol precursor composition.

6. The aerosol delivery device of claim 1, wherein the cartridge defines a mouth end and a connecting end, and wherein the connecting end includes a threaded portion configured to thread into an engaging end of the control body.

7. The aerosol delivery device of claim 1, wherein the two or more separate sections comprises at least three separate sections, wherein one of the sections comprises a solid section, wherein at least two other sections comprise flavor sections, and wherein at least two of the flavor sections contain different flavorants.

8. The aerosol delivery device of claim 1, wherein the two or more separate sections comprises nine separate sections, wherein one of the sections comprises a solid section, wherein the eight other sections comprise flavor sections, and wherein each of the flavor sections contains a different flavorant.

9. The aerosol delivery device of claim 8, further comprising a cartridge base that includes eight passageways, wherein each passageway is configured to align with a separate respective flavor section so as to facilitate flow of the aerosol precursor composition from the reservoir tank through a selected flavor section and to the atomizer.

10. The aerosol delivery device of claim 1, wherein the flavor section comprises an outer shell defining an inner surface that surrounds an inner chamber, wherein the outer shell comprises a porous material that contains the flavorant, and wherein the inner chamber is configured to allow the aerosol precursor composition to flow therethrough against the inner surface.

11. The aerosol delivery device of claim 1, wherein the opening is located on a masking component.

12. The aerosol delivery device of claim 11, wherein the masking component comprises a masking disc.

13. The aerosol delivery device of claim 1, wherein the two or more separate sections are located on a flavor component.

14. The aerosol delivery device of claim 13, wherein the flavor component comprises a flavor disc.

15. A cartridge for use in an aerosol delivery device, comprising:

a reservoir tank configured to contain an aerosol precursor composition;

an opening configured to the permit aerosol precursor composition to pass therethrough; and two or more separate sections, wherein at least two of the sections are configured to permit the aerosol precursor composition to pass therethrough, and at least one of the sections comprises a flavor section that contains a flavorant, and wherein a selected section of the two or more sections is configured to align with the opening so as to allow the aerosol precursor composition to flow from the reservoir tank through the opening and the selected section such that, when the flavor section is selected, a flavor from the flavorant is imparted to the aerosol precursor composition.

16. The cartridge of claim 15, wherein one of the two or more sections comprises a solid section configured to block the flow of the aerosol precursor composition when then opening is aligned therewith.

17. The cartridge of claim 15, further comprising a cartridge base that includes two or more passageways, wherein each passageway is configured to align with a separate section so as to facilitate flow of the aerosol precursor composition from the reservoir tank through the selected section.

18. The cartridge of claim 15, wherein the reservoir tank is configured to be rotated so as to align the opening with a selected section.

19. The cartridge of claim 15, wherein the reservoir tank comprises a housing that includes a liquid cavity defined therein, and wherein the liquid cavity is configured to contain the aerosol precursor composition.

20. The cartridge of claim 15, further comprising a mouth end and a connecting end, and wherein the connecting end includes a threaded portion.

21. The cartridge of claim 15, wherein the two or more separate sections comprises at least three separate sections, wherein one of the sections comprises a solid section, wherein at least two other sections comprise flavor sections, and wherein at least two of the flavor sections contain different flavorants.

22. The cartridge of claim 15, wherein the two or more separate sections comprises nine separate sections, wherein one of the sections comprises a solid section, wherein the eight other sections comprise flavor sections, and wherein each of the flavor sections contains a different flavorant.

23. The cartridge of claim 22, further comprising a cartridge base that includes eight passageways, wherein each passageway is configured to align with a separate respective flavor section so as to facilitate flow of the aerosol precursor composition from the reservoir tank through a selected flavor section.

24. The cartridge of claim 15, wherein the flavor section comprises an outer shell defining an inner surface that surrounds an inner chamber, wherein the outer shell comprises a porous material that contains the flavorant, and wherein the inner chamber is configured to allow the aerosol precursor composition to flow therethrough against the inner surface.

25. The cartridge of claim 15, wherein the opening is located on a masking component.

26. The cartridge of claim 25, wherein the masking component comprises a masking disc.

27. The cartridge of claim 15, wherein the two or more separate sections are located on a flavor component.

28. The cartridge of claim 27, wherein the flavor component comprises a flavor disc.

* * * * *